US009195200B2

(12) United States Patent
Kogusuri

(10) Patent No.: US 9,195,200 B2
(45) Date of Patent: Nov. 24, 2015

(54) IMAGE FORMING APPARATUS, IMAGE FORMING METHOD, AND COMPUTER PROGRAM PRODUCT

(71) Applicant: Yuji Kogusuri, Kanagawa (JP)

(72) Inventor: Yuji Kogusuri, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/487,781

(22) Filed: Sep. 16, 2014

(65) Prior Publication Data

US 2015/0078769 A1 Mar. 19, 2015

(30) Foreign Application Priority Data

Sep. 17, 2013 (JP) ..... 2013-192417
Aug. 18, 2014 (JP) ..... 2014-166160

(51) Int. Cl.
*G03G 15/01* (2006.01)
*G03G 15/00* (2006.01)

(52) U.S. Cl.
CPC ..... *G03G 15/6585* (2013.01); *G03G 15/6579* (2013.01); *G03G 2215/00447* (2013.01); *G03G 2215/00751* (2013.01)

(58) Field of Classification Search
CPC ..... G03G 15/6585; G03G 15/6579; G03G 2215/00447; G03G 2215/00751
USPC ..... 399/39
See application file for complete search history.

(56) References Cited

U.S. PATENT DOCUMENTS

2012/0062956 A1 3/2012 Kitagawa et al.
2012/0063802 A1 3/2012 Suzuki et al.
2012/0189337 A1* 7/2012 Takemura ..... 399/67
2012/0269525 A1* 10/2012 Shindo ..... 399/39

FOREIGN PATENT DOCUMENTS

JP 2012-150361 A 8/2012

* cited by examiner

*Primary Examiner* — David Gray
*Assistant Examiner* — Michael Harrison
(74) *Attorney, Agent, or Firm* — Oblon, McClelland, Maier & Neustadt, L.L.P.

(57) ABSTRACT

An acquisition unit acquires output data including first image data including first clear toner plane data and second image data including color plane data and second clear toner plane data. When the output data includes the first image data, a first output unit outputs first print data including first identification information representing an instruction to form an image on a first recording medium to which clear toner has not been applied to an image forming unit. When the output image includes the first image data and the second image data, a second output unit outputs second print data including second identification information representing an image formation instruction for a second recording medium to which the clear toner has been applied. When the output data does not include the first image data but includes the second image data, the second output unit outputs third print data including the first identification information.

6 Claims, 15 Drawing Sheets

FIRST PRINT DATA
·FIRST CLEAR TONER PLANE DATA
·PRINT ATTRIBUTE INFORMATION
(FIRST IDENTIFICATION INFORMATION)

SECOND PRINT DATA
·SECOND CLEAR TONER PLANE DATA
·COLOR PLANE DATA
·PRINT ATTRIBUTE INFORMATION
(SECOND IDENTIFICATION INFORMATION)

FIG.1
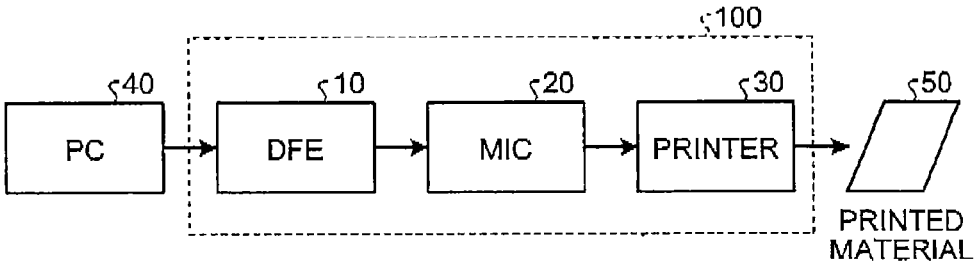
FIG.2
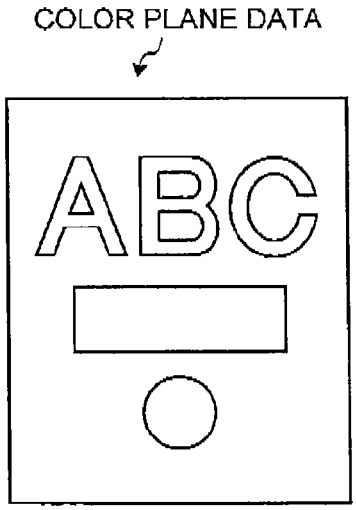
FIG.3
| GLOSS CONTROL NAME | GLOSS | DEVIATION |
|---|---|---|
| SPECULAR GLOSS (PG) | Gs≥80 | ΔGs≤10 |
| SOLID GLOSS (G) | Gs=Gs (SOLID GLOSS) | ΔGs≤10 |
| HALFTONE DOT MATT (M) | Gs=Gs (1C 30% HALFTONE DOT) | ΔGs≤10 |
| MATT (PM) | Gs≤10 | ΔGs≤10 |

| KIND OF SURFACE EFFECT DESIGNATED BY USER | DENSITY VALUE OF GLOSS CONTROL PLANE (%) |
|---|---|
| PG | 98% |
| G | 90% |
| M | 16% |
| PM | 6% |

| DRAWING OBJECT | COORDINATES | DENSITY VALUE |
|---|---|---|
| A, B, C | (x1, y1)-(x2, y2) | 98% |
| (RECTANGLE) | (x3, y3)-(x4, y4) | 90% |
| ... | ... | ... |

FIG.10

| INDEX | SHEET INFORMATION | | | | |
|---|---|---|---|---|---|
| | SHEET NAME | SHEET SIZE | THICKNESS [gsm] | ... | NUMBER OF FIXABLE TIMES |
| 1 | RICOH FULL COLOR PPC 6000 | A4 | 80 | | 2 |
| 2 | POD GLOSS COAT | LETTER | 128 | | 3 |
| 3 | MY PAPER | LETTER | 67 | | 1 |
| 4 | OFFICE PAPER NT | A4 | 66 | | 1 |
| 5 | COPY PRINTING SHEET | A3 | 157 | | 3 |
| | | ⋮ | | | |
| | | | | | |
| 99 | NO_DATA | - | - | | - |
| 100 | NO_DATA | - | - | | - |

FIG.11

| DENSITY (%) | DENSITY | | | EFFECT | CLEAR TONER PLANE 1 (PRINTER) |
|---|---|---|---|---|---|
| | REPRESENTATIVE VALUE | NUMERICAL RANGE | | | |
| 98% | 250 | 248 | 255 | SPECULAR GLOSS TYPE A | INVERSE MASK A |
| 96% | 245 | 243 | 247 | SPECULAR GLOSS TYPE B | INVERSE MASK B |
| 94% | 240 | 238 | 242 | SPECULAR GLOSS TYPE C | INVERSE MASK C |
| 92% | 235 | 233 | 237 | RESERVED | |
| 90% | 230 | 228 | 232 | SOLID GLOSS TYPE 1 | INVERSE MASK m |
| 88% | 224 | 222 | 227 | SOLID GLOSS TYPE 2 | |
| 86% | 219 | 217 | 221 | SOLID GLOSS TYPE 3 | |
| 84% | 214 | 212 | 216 | SOLID GLOSS TYPE 4 | |
| 44% | 112 | 110 | 114 | WATERMARK CHARACTER 3 () | NO DATA |
| 42% | 107 | 105 | 109 | WATERMARK CHARACTER 2 (COPY PROHIBITION) | NO DATA |
| 40% | 102 | 100 | 104 | WATERMARK CHARACTER 1 (SAMPLE) | NO DATA |
| 38% | 97 | 95 | 99 | RESERVED | |
| 36% | 92 | 90 | 94 | RESERVED | |
| 34% | 87 | 85 | 89 | GROUND TINT PATTERN 3 () | NO DATA |
| 32% | 82 | 80 | 84 | GROUND TINT PATTERN 2 (GRID) | NO DATA |
| 30% | 76 | 74 | 79 | GROUND TINT PATTERN 1 (WAVE) | NO DATA |
| 28% | 71 | 69 | 73 | RESERVED | |
| 26% | 66 | 64 | 68 | RESERVED | |
| 24% | 61 | 59 | 63 | TACTILE PATTERN TYPE 3 (ROUGH) | NO DATA |
| 22% | 56 | 54 | 58 | TACTILE PATTERN TYPE 2 (INTERMEDIATE) | NO DATA |
| 20% | 51 | 49 | 53 | TACTILE PATTERN TYPE 1 (FINE) | NO DATA |
| 18% | 46 | 44 | 48 | RESERVED | |
| 16% | 41 | 39 | 43 | HALFTONE DOT MATT TYPE 4 | HALFTONE 4 |
| 14% | 36 | 34 | 38 | HALFTONE DOT MATT TYPE 3 | HALFTONE 3 |
| 12% | 31 | 29 | 33 | HALFTONE DOT MATT TYPE 2 | HALFTONE 2 |
| 10% | 25 | 23 | 28 | HALFTONE DOT MATT TYPE 1 | HALFTONE 1 |
| 8% | 20 | 18 | 22 | RESERVED | |
| 6% | 15 | 13 | 17 | MATT TYPE C | NO DATA |
| 4% | 10 | 8 | 12 | MATT TYPE B | NO DATA |
| 2% | 5 | 1 | 7 | MATT TYPE A | NO DATA |
| 0% | 0 | 0 | 0 | NONE | NO DATA |

OMITTED

FIG.14

| PAGE IDENTIFICATION NUMBER | SHEET INFORMATION | | | | | | | | | | |
|---|---|---|---|---|---|---|---|---|---|---|---|
| | FIXING INFORMATION | | | PRINT ATTRIBUTE INFORMATION | | | | | CHARGE INFORMATION | | |
| | FIXING DESIGNATION INFORMATION | CLEAR TONER PLANE (FRONT SIDE) OF FIRST TIME | CLEAR TONER PLANE (REAR SIDE) OF FIRST TIME | JOB START/ END | SINGLE SIDED/ DOUBLE SIDED | SHEET SIZE | SHEET FEED TRAY | SHEET DISCHARGE TRAY | CHARGE COUNT VALUE (MONO-CHROME) | CHARGE COUNT VALUE (COLOR) | CHARGE COUNT VALUE (CLEAR) |
| 10001 | ON | PRESENCE | PRESENCE | START | DOUBLE SIDED | A4 | TRAY 1 | FINISHER TRAY | 0 | 2 | 2 |
| 10002 | OFF | NO PRESENCE | NO PRESENCE | – | DOUBLE SIDED | A4 | TRAY 1 | FINISHER TRAY | 0 | 2 | 0 |
| 10003 | ON | PRESENCE | NO PRESENCE | – | DOUBLE SIDED | A4 | TRAY 1 | FINISHER TRAY | 0 | 2 | 1 |
| 10004 | ON | NO PRESENCE | PRESENCE | – | DOUBLE SIDED | A4 | TRAY 1 | FINISHER TRAY | 0 | 2 | 1 |
| 10005 | OFF | NO PRESENCE | NO PRESENCE | END | DOUBLE SIDED | A4 | TRAY 1 | FINISHER TRAY | 0 | 1 | 0 |

FIG.15A

FIRST PRINT DATA
·FIRST CLEAR TONER PLANE DATA
·PRINT ATTRIBUTE INFORMATION
(FIRST IDENTIFICATION INFORMATION)

FIG.15B

SECOND PRINT DATA
·SECOND CLEAR TONER PLANE DATA
·COLOR PLANE DATA
·PRINT ATTRIBUTE INFORMATION
(SECOND IDENTIFICATION INFORMATION)

FIG.15C

THIRD PRINT DATA
·SECOND CLEAR TONER PLANE DATA
·COLOR PLANE DATA
·PRINT ATTRIBUTE INFORMATION
(FIRST IDENTIFICATION INFORMATION)

IMAGE FORMING APPARATUS, IMAGE FORMING METHOD, AND COMPUTER PROGRAM PRODUCT

CROSS-REFERENCE TO RELATED APPLICATIONS

The present application claims priority to and incorporates by reference the entire contents of Japanese Patent Application No. 2013-192417 filed in Japan on Sep. 17, 2013 and Japanese Patent Application No. 2014-166160 filed in Japan on Aug. 18, 2014.

BACKGROUND OF THE INVENTION

1. Field of the Invention

The present invention relates to an image forming apparatus, an image forming method, and a computer program product.

2. Description of the Related Art

A technology for raising the glossiness of an image by printing toner of four colors including cyan, magenta, yellow, and black and clear toner on a sheet in an overlapping manner has been known. For example, there is a technology for completing image formation by performing printing for one sheet twice (hereinafter, referred to as a two-pass printing).

In addition, in Japanese Patent Application Laid-open No. 2012-150361, a printing system has been disclosed in which information of each page included in print data is acquired, and, in printing of each page included in the print data, a sheet feed cassette of a first image forming apparatus or a second image forming apparatus from which a sheet is fed is determined, sheet feeding is performed from the selected sheet feed cassette, and print data is printed.

However, in the conventional technology, in order to perform two-pass printing using one image forming apparatus, also for a sheet for which printing of the first time is not necessary, printing is performed twice, and there is a problem in that a time corresponding to the printing for the sheet for which the printing of the first time is not necessary is wasted.

Therefore, there is a need for an image forming apparatus, an image forming method, and a computer program product that are capable of efficiently forming an image even in a case where printing is performed a plurality of times for a recording medium.

SUMMARY OF THE INVENTION

According to an embodiment, an image forming apparatus includes an acquisition unit, a first output unit, and a second output unit. The acquisition unit acquires output data that includes at least one of first image data and second image data. The first image data includes first clear toner plane data that defines a special color area to which special color toner is applied for a first recording medium to which the special color toner has not been applied. The second image data includes color plane data and second clear toner plane data. The color plane date defines a color area to which color toner is applied for the first recording medium or a second recording medium to which the special color toner has been applied. The second clear toner plane data defines a special color area to which the special color toner is applied for the first recording medium or the second recording medium. When the output data includes the first image data, the first output unit outputs first print data that includes the first clear toner plane data and first identification information representing an instruction to form an image on the first recording medium stored in a first sheet feed tray that stores the first recording medium to an image forming unit. When the output data includes the first image data and the second image data, the second output unit outputs second print data that includes the second clear toner plane data, the color plane data, and second identification information representing an instruction to form an image on the second recording medium stored in a second sheet feed tray that stores the second recording medium to the image forming unit. When the output data does not include the first image data but includes the second image data, the second output unit outputs third print data that includes the second clear toner plane data, the color plane data, and the first identification information to the image forming unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 1 is a block diagram that illustrates an example of the schematic configuration of an image forming apparatus according to a first embodiment;

FIG. 2 is an explanatory diagram that illustrates an example of color plane data;

FIG. 3 is an explanatory diagram that illustrates a surface effect;

FIG. 10 is a diagram that illustrates an example of the data structure of sheet information;

FIG. 11 is a diagram that illustrates the data configuration of a surface effect selection table;

FIG. 14 is a diagram that illustrates an example of sheet information;

FIGS. 15A to 15C are diagrams that each illustrates an example of the data configuration of print data;

DETAILED DESCRIPTION OF THE PREFERRED EMBODIMENTS

Figures 4, 5, 6:
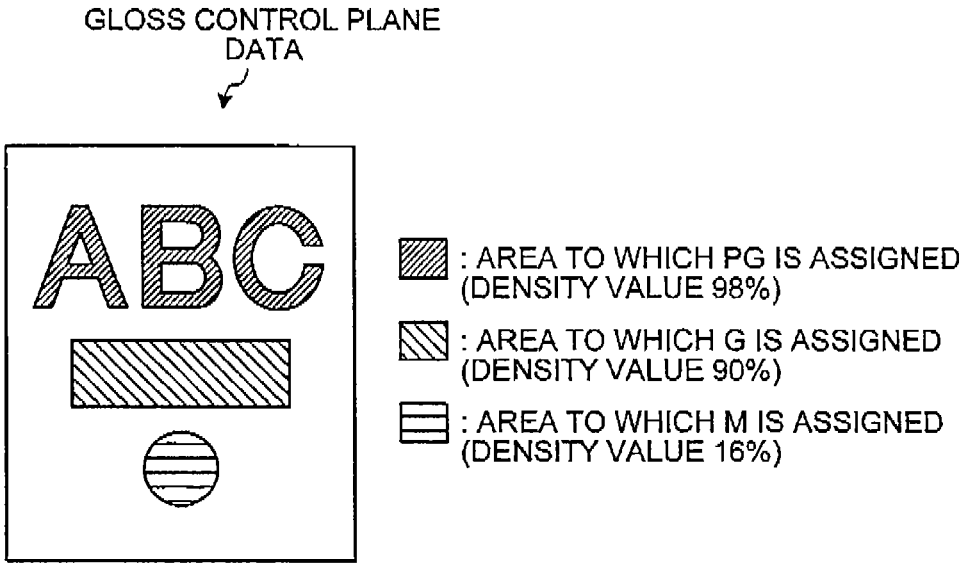
FIG. 4 is an explanatory diagram that illustrates an example of gloss control plane data.
FIG. 5 is a diagram that illustrates an example of a density value selection table.
FIG. 6 is a diagram that illustrates the correspondence relation between a drawing object, coordinates, and a density value.

Hereinafter, image forming apparatuses, image forming methods, and programs according to embodiments will be described in detail with reference to the accompanying drawings.

First Embodiment

First, an example of the configuration of an image forming apparatus (image forming system) according to a first embodiment will be described with reference to FIG. 1. FIG. 1 is a block diagram that illustrates an example of the schematic configuration of an image forming apparatus 100 according to the first embodiment. As illustrated in FIG. 1, the image forming apparatus 100 is configured by connecting a control device (DFE: Digital Front End) 10, an interface controller (MIC: Mechanism I/F Controller) 20, and a printer (image forming unit) 30 together.

The DFE 10 communicates with the printer 30 through the MIC 20, thereby controlling the formation of an image in the printer 30. In addition, a personal computer (PC) 40 is connected (may be connected through a network) to the DEE 10. The PC 40 generates document data described in a language such as a page description language (PDL) using an application that is installed in advance and transmits the generated document data to the DFE 10.

Then, the DFE 10 divides the document data into data for image formation of the first time and data for image formation of the second time and transmits the print data (to be described later in detail) in units of pages to the printer 30 through the MIC 20.

The DFE 10 includes: a Central Processing Unit (CPU) controlling the entire device; a main storage unit such as a ROM and a RAM storing various kinds of data and various programs; and an auxiliary storage unit such as an HDD storing various kinds of data and various programs as the ff configuration. Various processes of the DFE 10 are implemented by the CPU of the DFE 10 executing various programs stored in the main storage unit or the auxiliary storage unit. However, the present invention is not limited thereto, and such functions may be implemented by an individual circuit (hardware).

The MIC 20 outputs the print data to the printer 30 in accordance with timing. In the printer 30, color toner of colors CMYK and special Color toner are installed, and, for each toner, an image forming unit including a photoconductor, an electric charger, a developing device, and a photoconductor cleaner, an exposure device, and a fixing device (hereinafter, referred to as an image forming mechanism) are installed.

Here, the special color toner is toner that is used for representing a special color. The special color toner, for example, is clear toner, metallic toner, or white toner. The clear toner is transparent (colorless) toner not including any coloring material. Here, transparency (colorlessness), for example, represents a percent transmittance of 70% or more. In addition, the metallic toner is toner of a gold color, a silver color, or the like having high glossiness. In this embodiment, a case will be described as an example in which the clear toner is used as the special color toner.

The printer 30 emits light beams from the exposure device in accordance with the print data that is transmitted from the DFE 10 through the MIC 20, thereby forming toner images of the colors on the photoconductor. Then, the printer 30 transfers the toner images of the colors formed on the photoconductor on a recording medium while the toner images overlap one another. The toner images transferred on the recording medium are fixed by the heat and the pressure by the fixing device. Accordingly, an image is formed on the recording medium, whereby a printed material 50 is acquired.

The recording medium is a medium on which an image can be formed. The recording medium, for example, is a paper medium, a synthetic sheet, a vinyl sheet, or the like.

Here, the document data that is transmitted from the PC 40 to the DFE 10 will be described. The PC 40 generates the document data using an image processing application that is installed in advance and transmits the generated document data to the DFE 10. In such an image processing application, in addition to color plane data that defines the value of the density (referred to as a density value) of each color of each color plane such as an RGB plane or a CMYK plane for each pixel, special color plane data can be handled. The special color plane data is image data used for attaching special toner or special ink of a white color, gold, or silver other than basic colors such as CMYK or RGB and is data dedicatedly used for a printer in which such special toner or special ink is installed. In the special color plane data, in order to improve the color reproducibility, R may be added to the basic colors of CMYK, or Y may be added to the basic colors of RGB. Commonly, clear toner is handled as one special color.

In this embodiment, the clear toner as the special color toner is used for applying a surface effect that is a visual or tactile effect applied to a recording medium.

For input image data, the image processing application of the PC 40 generates image data of a glossiness control plane (hereinafter, referred to as "glossiness control plane data") in accordance with a user's designation as the special color plane image data in addition to color plane image data (hereinafter, referred to as "color plane data").

The color plane data is image data that defines a color area to which color toner is applied. More specifically, the color plane data is image data that defines density values of colors of RGB, CMYK, or the like for each pixel. The color plane data generated by the PC 40 represents one pixel in eight bits. FIG. 2 is an explanatory diagram that illustrates an example of the color plane data. In FIG. 2, density values corresponding to colors designated by the user using the image processing application are assigned to each of drawing objects such as "A", "B", and "C".

The glossiness control plane data is image data that specifies, in order to control the attachment of clear toner in accordance with a surface effect that is a visual or tactile effect applied to a recording medium, an area to which the surface effect is applied and the kind of the surface effect.

The glossiness control plane data, similarly to the color plane data of colors of RGB, CMYK, or the like, is represented as a density value in the range of "0" to "255" using eight bits for each pixel, and the kind of the surface effect is associated with this density value (the density value may be represented in 16 bits or 32 bits or 0 to 100%). In addition, the same value is set to a range in which the same surface effect is desired to be applied regardless of the density of the clear toner that is actually attached. Accordingly, even when data representing an area is not present, the area to which the surface effect is applied can be easily specified based on the glossiness control plane data as is necessary. In other words, the kind of the surface effect and an area to which the surface effect is applied are represented by the glossiness control plane data (data representing the area may be separately provided).

The PC 40 sets, for each drawing object, the kind of the surface effect for the drawing object that is designated through an image processing application by the user as a density value and generates glossiness control plane data in the form of a vector.

Each pixel configuring the glossiness control plane data corresponds to each pixel of the color plane data. In addition, in the glossiness control plane data and the color plane data, a density value represented by each pixel is a pixel value. In addition, both the color plane data and the glossiness control plane data are configured in units of pages.

As the kinds of the surface effects, when largely classified, there are glossiness/non-glossiness, surface protection, a watermark in which information is embedded, a texture, and the like. As the surface effects relating to the glossiness/non-glossiness, as illustrated in FIG. 3 as an example, there are four kinds, when largely classified, there are kinds of specular gloss (PG: Premium Gloss), solid gloss (G: Gloss), halftone dot matt (M: Matt), matt (PM: Premium Matt), and the like in order of highest to lowest degree of gloss (glossiness). Hereinafter, the specular gloss may be referred to as "PG"; the solid gloss may be referred to as "G"; the halftone dot matt may be referred to as "M"; and the mattering may be referred to as "PM".

The specular gloss and the solid gloss have high degrees of gloss, and, contrary to this, the halftone dot matt and the mattering are used for suppressing the gloss. Particularly, the mattering provides the glossiness that is lower than that of an ordinary sheet. As illustrated in FIG. 3, the specular gloss represents a glossiness Gs of 80 or more, the solid gloss represents a glossiness formed by a primary color or a secondary color, the halftone dot matt represents a glossiness of 30% of a primary color and a halftone dot, and the mattering represents a glossiness of 10 or less. In addition, the deviation of the glossiness is denoted by $\Delta Gs$ and is configured to be 10 or less. For each kind of such surface effects, a high density value is associated with a surface effect having a high degree of gloss, and a low density value is associated with a surface effect suppressing the gloss. In addition, a surface effect such as a watermark or a texture is associated with an intermediate density value. As the watermark, for example, a character, a ground tint, or the like is used. The texture represents a character or a pattern and can apply a tactile effect in addition to a visual effect. For example, the pattern of stained glass can be expressed by the clear toner. The surface protection may be substituted by the specular gloss or the solid gloss.

An area of the image represented by image data that is the processing target to which the surface effect is applied and the kind of the surface effect that is applied to the area are designated through an image processing application by the user. The PC 40 executing the image processing application sets a density value corresponding to the surface effect designated by the user to a drawing object configuring the area designated by the user, thereby generating gloss control plane data. The correspondence relation between the density value and the kind of the surface effect will be described later.

FIG. 4 is an explanatory diagram that illustrates an example of the gloss control plane data. In the example represented in FIG. 4, an example is illustrated in which, by a user, a surface effect of "PG (specular gloss)" is assigned to drawing object "ABC", a surface effect of "G (solid gloss)" is assigned to drawing object "(rectangular pattern)", and a surface effect of "M (halftone dot matt)" is assigned to drawing object "(circular pattern)". In addition, the density value set to each surface effect is a density value determined in accordance with the kind of the surface effect in a density value selection table to be described later.

In this way, the gloss control plane data is generated as a plane different from the color plane data by the image processing application of the PC 40. In addition, as the formats of the color plane data and the gloss control plane data, a portable document format (PDF) is used, and document data is generated by integrating the PDF image data of the respective planes. However, the data formats of the image data of the respective planes (the color plane data and the gloss control plane data) are not limited to the PDF, and an arbitrary format may be used.

Here, the image processing application of the PC 40 converts the kind of the surface effect designated by the user into a density value and generates the gloss control plane data. Such a conversion is performed by referring to the density value selection table that is stored in the storage unit of the PC 40 in advance. The density value selection table has table data in which the kind of a surface effect and a density value of the gloss control plane corresponding to the kind of the surface effect are associated with each other.

FIG. 5 is a diagram that illustrates an example of the density value selection table. In the example illustrated in FIG. 5, the density value of the gloss control plane that corresponds to an area to which the "PG" (specular gloss) is assigned by the user is a pixel value corresponding to "98%", the density value of the gloss control plane that corresponds to an area to which the "G" (solid gloss) is assigned is a pixel value corresponding to "90%", the density value of the gloss control plane that corresponds to an area to which the "M" (halftone dot matt) is assigned is a pixel value corresponding to "16%", and the density value of the gloss control plane that corresponds to an area to which the "PM" (matt) is assigned is a pixel value corresponding to "6%".

This density value selection table has the same data as a surface effect selection table (to be described later) that is stored in the DFE 10, and the control unit of the PC 40 acquires the surface effect selection table at predetermined timing, generates (copies) the density value selection table based on the acquired surface effect selection table, and stores the generated table in the storage unit. Here, while an example of the density value selection table has been simplified to be illustrated in FIG. 5, actually, the density value selection table is the same as the surface effect selection table to be described later. In addition, it may be configured such that the surface effect selection table is stored in a storage server (cloud) on a network such as the Internet, the surface effect selection table is acquired from the server, and the density value selection table is generated (copied) based on the acquired surface effect selection table. However, the surface effect selection table stored in the DFE 10 and the density value selection table stored in the PC 40 need to have the same data.

More specifically, the image processing application of the PC 40 sets the density value (gloss control value) of the drawing object to which a predetermined surface effect is assigned by the user to a value corresponding to the kind of the surface effect while referring to the density value selection table illustrated in FIG. 5, thereby generating the gloss control plane data. For example, a case will be considered in which, by the user, out of a target image that is the color plane data illustrated in FIG. 2, "PG" is assigned to the area represented as "ABC", "G" is assigned to the rectangular area, and "M" is assigned to the circular area. In this case, by referring to the density value selection table, the PC 40 sets the density value of the drawing object ("ABC") to which "PG" is assigned by the user to a pixel value corresponding to "98%", sets the density value of the drawing object ("rectangle") to which "G" is assigned to a pixel value corresponding to "90%", and sets the density value of the drawing object ("circle") to which "M" is assigned to a pixel value corresponding to "16%", thereby generating the gloss control plane data. The gloss control plane data generated by the PC 40 is data in the form of vectors each represented as a set of the coordinates of points, parameters of an equation of a line or a plane joining the points, and a drawing object representing filling, special effects, or the like. FIG. 4 is a diagram that illustrates this gloss control plane data as an image, and FIG. 6 is a diagram that illustrates the correspondence relation between a drawing object, coordinates, and a density value in the gloss control plane data illustrated in FIG. 4.

Then, the PC 40 generates document data that includes the gloss control plane data, the color plane data, and print attribute information. The print attribute information includes various kinds of information such as the start and the end of a job, single-sided/double-sided printing, a printing target face (the front side or the rear side), a sheet name, a sheet size, a sheet feed tray, and a sheet discharge tray. Then, the PC 40 outputs the document data to the DFE 10.

Figure 7:
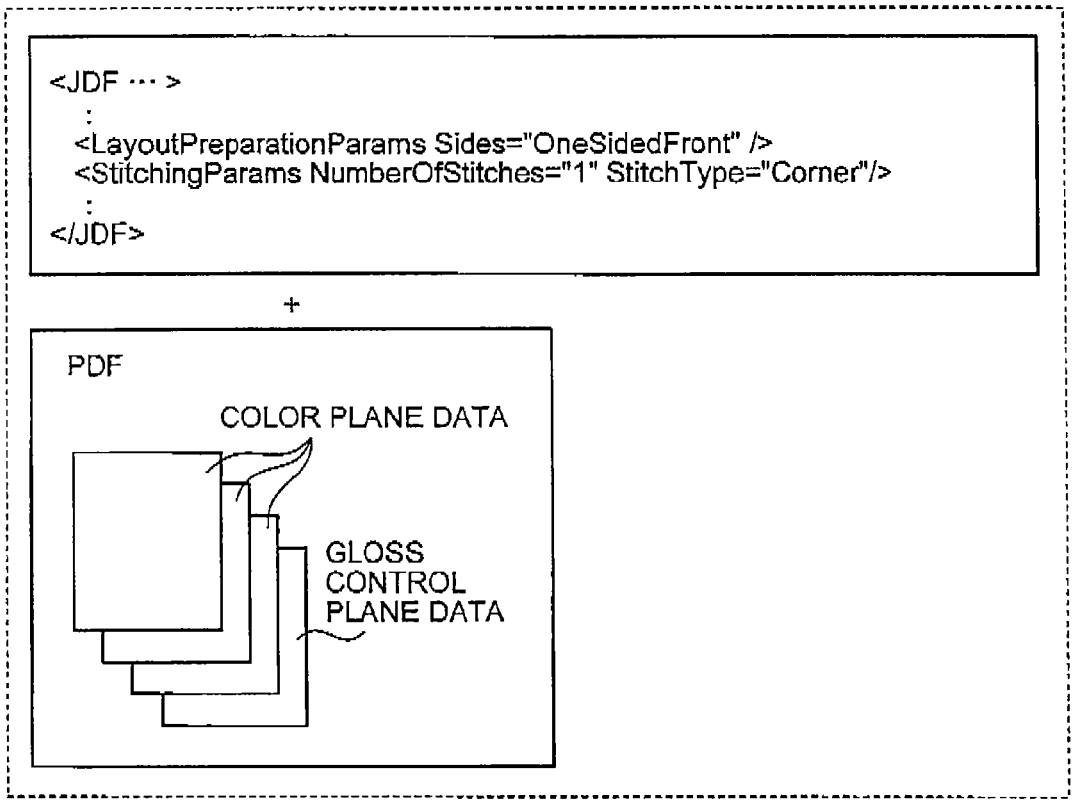
FIG. 7 is a schematic diagram that conceptually illustrates an example of the configuration of document data.

FIG. 7 is a schematic diagram that conceptually illustrates an example of the configuration of the document data. In the example illustrated in FIG. 7, while a job definition format (JDF) is used as the print attribute information, the print attribute information is not limited thereto. In addition, the document data may be converted into a PDL such as PostScript or may remain in the PDF format if the DFE 10 corresponds thereto.

The description will be continued with reference back to FIG. 1. After the DEE 10 receives the document data from the PC 40 and performs various processes to be described later for the document data, the DFE 10 outputs the print data to the printer 30 through the MIC 20. The DFE 10 will be described later in detail.

Figure 8:
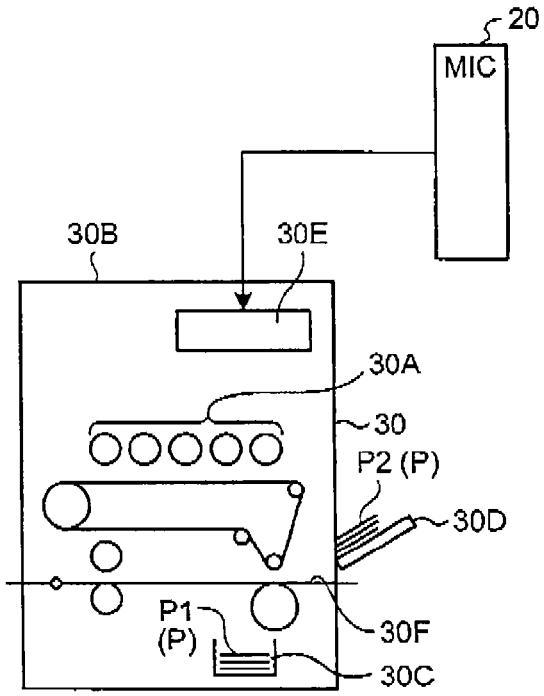
FIG. 8 is a schematic diagram that illustrates the configuration of a printer.

FIG. 8 is a schematic diagram that illustrates the configuration of the printer 30. The printer 30 includes: a plurality of photoconductors 30A of a electrophotographic system; a transfer belt onto which toner images formed on the photoconductors 30A are transferred; a transfer device that transfers the toner images formed on the transfer belt to a recording medium P; and a fixing device 30B that fixes the toner images formed on the recording medium P to the recording medium P. Electrostatic latent images respectively formed on the photoconductors 30A through the electrostatic photographic system are respectively developed using the color toners of the colors C, M, Y, and K and the clear toner. The toner images generated through the developing process are transferred onto the recording medium P and are fixed to the recording medium P by the fixing device 30B.

In addition, the printer 30 includes a first sheet feed tray 30C and a second sheet feed tray 30D.

Here, in this embodiment, the recording medium P includes a first recording medium P1 and a second recording medium P2. The first recording medium P1 is a recording medium P to which toner of each color such as the clear toner is not applied. The second recording medium P2 is a recording medium P to which the clear toner is applied. In other words, the first recording medium P1 is a recording medium P on which an image is not formed using toner. In addition, the second recording medium P2 is a recording medium P on which an image is formed by using toner.

The first sheet feed tray 30C is a tray that is used for storing the first recording medium P1. The second sheet feed tray 30D is a tray that is used for storing the second recording medium P2. The second sheet feed tray 30D, for example, is a manual feed tray. Here, the printer 30 may be configured to include a plurality of the first sheet feed trays 30C.

In addition, the printer 30 includes a control unit 30E that controls the printer 30. The control unit 30E performs control of each unit of the printer such that an image is formed on the recording medium P in accordance with the print data received from the DFE 10 through the MIC 20 (this will be described later in detail).

The control unit 30E performs control of a conveyance unit not illustrated in the figure such that the first recording medium P1 or the second recording medium P2 is conveyed from the first sheet feed tray 300 or the second sheet feed tray 30D identified by identification information (first identification information or second identification information) included in the print data to a conveyance path 30F. In addition, the control unit 30E performs control of each unit of the printer 30 such that toner (color toner or clear toner) according to the image data (first clear toner plane data, second clear toner plane data, or color plane data) included in the print data is applied to the conveyed recording medium P (the first recording medium P1 or the second recording medium P2) so as to form an image.

Next, the functional configuration of the DFE 10 will be described.

Figure 9:
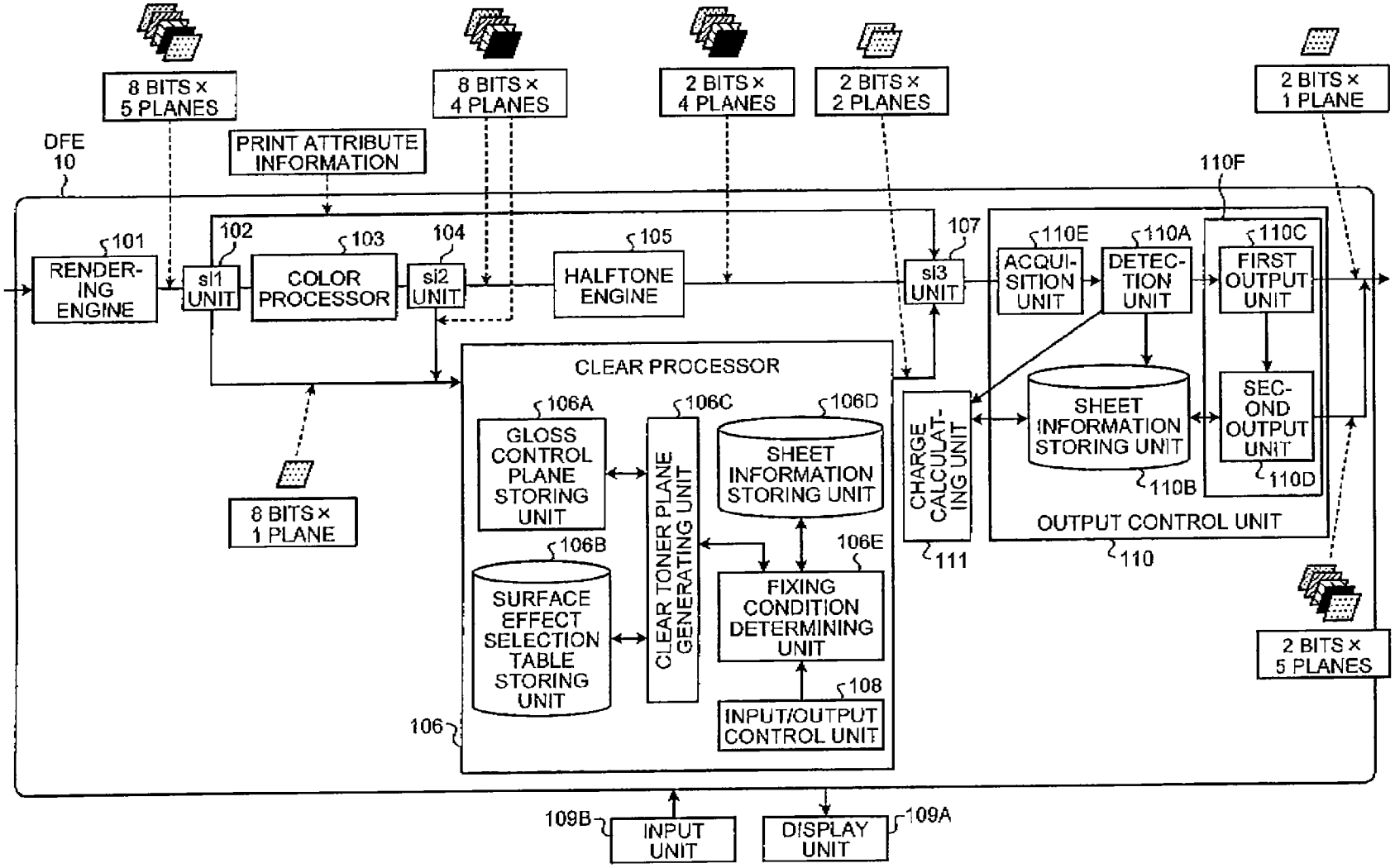
FIG. 9 is a diagram that illustrates an example of the configuration of a DFE.

FIG. 9 is a diagram that illustrates an example of the configuration of the DFE 10. The DFE 10, for example, as illustrated in FIG. 9, includes: a rendering engine 101; an si1 unit 102; a color processor 103; an sit unit 104; a halftone engine 105; a clear processor 106; an si3 unit 107; a charge calculating unit 111; and an output control unit 110. In addition, an input unit 109B and a display unit 109A are connected to the DFE 10 so as to transfer signals therebetween.

The rendering engine 101, the sit unit 102, the color processor 103, the s2 unit 104, the halftone engine 105, the clear processor 106, the si3 unit 107, the charge calculating unit 111, and the output control unit 110 are implemented by the control unit of the DFE 10 executing various programs stored in the main storage unit or the auxiliary storage unit. Each of the si1 unit 102, the si2 unit 104, and the si3 unit 107 has an image data separating function and an image data integrating function.

The input unit 109B is an input device such as a keyboard or a mouse. The display unit 109A is a display device such as a display.

The rendering engine 101, for the document data (see FIG. 7) generated by the PC 40, converts the vector format into the raster format, converts a color space represented in the RGB format or the like into a color space of the CMYK format, and outputs color plane data of the colors CMYK each having eight bits and the gloss control plane data of eight bits.

The si1 unit 102 outputs the color plane data of the colors CMYK each having eight bits and the print attribute information included in the document data to the color processor 103. In addition, the si1 unit 102 outputs the gloss control plane data of eight bits and the print attribute information to the clear processor 106. The rendering engine 101 converts the gloss control plane data of the vector format, which is output from the PC 40, into the gloss control plane data of the raster format. Specifically, the rendering engine 101 converts the kind of the surface effect for the drawing object that is designated by the user into gloss control plane data set as a density value in units of pixels. Then, the rendering engine 101 outputs the gloss control plane data of the raster format to the clear processor 106.

The color plane data of the colors CMYK each having eight bits and the print attribute information are input to the color processor 103 through the si1 unit 102. The color processor 103 performs gamma correction for the input color plane data using a gamma curve of 1D_LUT generated through calibration. As the image processing, there is a toner total amount regulating process in addition to the gamma correction. The total amount regulating process is a process of regulating the color plane data of the colors CMYK each having eight bits after the gamma correction due to the limitation of the amount of toner that can be applied to one pixel on the recording medium by the printer 30. In addition, in a case where printing is performed over the regulated total amount, the image quality is degraded due to a transfer defect or a fixing defect. In this embodiment, only the relating gamma correction is employed in the description.

The si2 unit 104 outputs the color plane data of the colors CMYK each having eight bits for which the gamma correction has been performed by the color processor 103 to the clear processor 106 as data used for generating an inverse mask (to be described later). The color plane data of the colors CMYK each having eight bits after the gamma correction and the print attribute information are input to the halftone engine 105 through the si2 unit 104. In order to output the color plane data of the colors CMYK each having eight bits for which the gamma correction has been performed to the printer 30, the halftone engine 105, for example, performs a halftone process of converting the data into a data format of color plane data of colors CMYK each having two bits. Then, the halftone engine 105 outputs the color plane data of the colors CMYK each having two bits or the like after the halftone process and the print attribute information to the si3 unit 107. Here, the two bits represent an example, and the number of bits is not limited thereto.

The si3 unit 107 outputs output data that includes: the print attribute information; the color plane data of the colors CMYK each having two bits for which the halftone process has been performed by the halftone engine 105; clear toner plane data (first clear toner plane data and second clear toner plane data) generated by the clear processor 106 to be described later; fixing designation information indicating whether a fixing process is performed a plurality of times; and the print attribute information to the output control unit 110 (this will be described later in detail).

Next, the clear processor 106 will be described in detail.

The clear processor 106 receives the gloss control plane data of eight bits and the print attribute information from the si1 unit 102. In addition, the clear processor 106 may receive the color plane data of the colors CMYK each having eight bits for which the gamma correction has been performed from the sit unit 104.

The clear processor 106 mainly includes: a surface effect selection table storing unit 106B; a gloss control plane storing unit 106A; a clear toner plane generating unit 106C; a sheet information storing unit 106D; a fixing condition determining unit 106E; and an input/output control unit 108.

The gloss control plane storing unit 106A stores the input gloss control plane data of eight bits. The sheet information storing unit 106D stores sheet information of each recording medium.

The sheet information storing unit 106D stores the identification information of a recording medium specified by the sheet information and the sheet information with being associated with each other. FIG. 10 is a diagram that illustrates an example of the data structure of the sheet information. The sheet information is associated with each "Index" that is the identification information of a recording medium and includes a "sheet name", a "sheet size", a "sheet thickness", the "number of fixable times", and the like. The "number of fixable times" is the number of fixable times for a recording medium.

Referring back to FIG. 9, the surface effect selection table storing unit 106B stores the surface effect selection table.

The fixing condition determining unit 106E determines a toner fixing condition for a recording medium that is an image formation target based on the printing setting that is input by the user and the sheet information that is stored in the sheet information storing unit 106D.

The clear toner plane generating unit 106C generates clear toner plane data of two bits by referring to the gloss control plane data of eight bits stored in the gloss control plane storing unit 106A, the surface effect selection table stored in the surface effect selection table storing unit 106B, and the fixing condition determined by the fixing condition determining unit 106E (the function for performing halftone processing of the clear toner plane of eight bits into two bits is included in this clear toner plane generating unit 1060).

More specifically, the clear toner plane generating unit 106C determines a surface effect corresponding to the density value (pixel value) represented by each pixel that configures the gloss control plane data. Then, the clear toner plane generating unit 106C appropriately generates an inverse mask or a solid mask by using the input color plane data of the colors CMYK each having eight bits in accordance with the determination, thereby appropriately generating clear toner plane data of two bits that defines a special color area to which clear toner is attached.

At this time, the clear toner plane generating unit 1060 generates at least one of the first clear toner plane data and the second clear toner plane data as the clear toner plane data in accordance with the fixing condition (this will be described later in detail). In this embodiment, in a case where the first clear toner plane data and the second clear toner plane data are collectively described, they will be referred to as the clear toner plane data only in the description.

The first clear toner plane data is clear toner plane data that defines a special color area to which clear toner is applied for the first recording medium P1 (the first recording medium to which the clear toner has not been applied). In a case where the printer 30 performs image formation of the two-pass system that forms an image by repeating a plurality of times (for example, twice) of performing the image forming process (also referred to as a fixing process), the first clear toner plane data is data that defines a special color area of the first recording medium P1 to which clear toner is applied in the first (first-pass) fixing process.

The second clear toner plane data is clear toner plane data that defines a special color area to which clear toner is applied for the first recording medium P1 or the second recording medium P2. Specifically, in a case where the printer 30 performs image formation of the two-pass system that forms an image by repeating a plurality of times (for example, twice) of performing the image forming process (also referred to as a fixing process), the second clear toner plane data is data that defines a special color area of the recording medium P (the first recording medium P1 or the second recording medium P2) to which clear toner is applied in the first (first-pass) fixing process or the second (second-pass) fixing process.

Here, the inverse mask is used for configuring a total attachment amount acquired by summing the color toner of the colors CMYK and the clear toner on each pixel configuring the target area to which the surface effect is applied to be uniform. More specifically, in the color plane data of the colors CMYK, density values represented by pixels configuring the target area are added together, and image data acquired by subtracting the added value from a predetermined value is the inverse mask. For example, the inverse mask is represented by the following Equation (1)

$$Clr=100-(C+M+Y+K), \text{ but, when } Clr<0, Clr=0 \quad (1)$$

In Equation (1), Clr, C, M, Y, and K represent density ratios converted from the density values of each pixel for the clear toner and the color toner of the colors C, M, Y, and K. According to Equation (1), a total attachment amount acquired by adding the attachment amount of the clear toner to a total attachment amount of the color toner of the colors C, M, Y, and K is set to 100% for all the pixels configuring the target area to which the surface effect is applied. In a case where the total attachment amount of the toner of the colors C, M, Y, and K is 100% or more, the clear toner is not attached, and the density ratio of the clear toner is set to 0%. The reason for this is that a portion in which the total attachment amount of the color toner of the colors C, M, Y, and K exceeds 100% is smoothed through the fixing process. In this way, by configuring the total attachment amounts for all the pixels that configure the target area to which the surface effect is applied to be 100% or more, there is no unevenness of the surface due to a difference in the total attachment amounts of toner in the target area, and, as a result, gloss according to the specular reflection of light occurs. However, there are more requirements other than Equation (1) for the inverse mask, and there may be a plurality of kinds of the inverse mask.

Next, the surface effect selection table stored in the surface effect selection table storing unit 106B will be described.

FIG. 11 is a diagram that illustrates the data configuration of the surface effect selection table. The surface effect selection table is a table that represents the correspondence relation between the density value and the kind of the surface effect and the correspondence relation with the clear toner plane data used by the printer 30.

In the correspondence relation between the kind of the surface effect and the density value illustrated in FIG. 11, each kind of the surface effect is associated with a range of density values. In addition, each kind of the surface effect is associated with a ratio of the density (density ratio) converted from a value (representative value) that is the representative of the range of the density values in units of 2%. More specifically, the surface effects (the specular gloss and the solid gloss) applying the gloss are associated with ranges ("212" to "255") of density values of which the density ratios are 84% or more. In addition, the surface effects (the halftone dot matt and the matt) suppressing the gloss are associated with ranges ("1" to "43") of density values of which the density ratios are 16% or less. Furthermore, the surface effects such as a texture and a ground tint watermark are associated with ranges of density values of which the density ratios are in the range of 20% to 80%.

More specifically, for example, the specular gloss (PG: Premium Gloss) is associated with pixel values of "238" to "255" as the surface effect. Among these, specular glosses of mutually different types are associated with three ranges of pixel values of "238" to "242", pixel values of "243" to "247", and pixel values of "248" to "255". In addition, the solid gloss (G: Gloss) is associated with pixel values of "212" to "232", and, among these, the solid glosses of mutually different types are associated with four ranges of pixel values of "212" to "216", pixel values of "217" to "221", pixel values of "222" to "227", and pixel values of "228" to "232".

Furthermore, the halftone dot matt (M: Matt) is associated with pixel values of "23" to "43", and, among these, the halftone dot matts of mutually different types are associated with four ranges of pixel values of "23" to "28", pixel values of "29" to "33", pixel values of "34" to "38", and pixel values of "39" to "43".

In addition, the matt (PM: Premium Matt) is associated with pixel values of "1" to "17", and, among these, the matts of mutually different types are associated with three ranges of pixel values of "1" to "7", pixel values of "8" to "12", and pixel values of "13" to "17".

In the mutually different types of the same surface effect, there are differences in the equations for acquiring the clear toner plane data used by the printer 30 or a low-temperature fixing device not illustrated in the figure, and the operation of the main body of the printer 30 is the same. In addition, no application of any surface effect is associated with a density value of "0".

In a case where the density value is in the range of "228" to "232", and the surface effect is the solid gloss, the clear toner plane data used by the printer 30 is the inverse mask m. In addition, in a case where the surface effect is the halftone dot matt, the clear toner plane data used by the printer 30 represents a halftone (halftone dot).

The clear processor 106, by referring to the surface effect selection table, determines a surface effect that is associated with each pixel value represented by the gloss control plane data and determines clear toner plane data to be used by the printer 30. Then, as described above, the clear processor 106 generates and outputs the clear toner plane data in accordance with a result of the determination (this will be described later in detail).

Referring back to FIG. 9, the input/output control unit 108 performs display control of various screens such as an input screen of printing settings for the display unit 109A and input control of various designations such as printing settings performed through the input screen of the printing settings from the input unit 109B.

Figure 12:
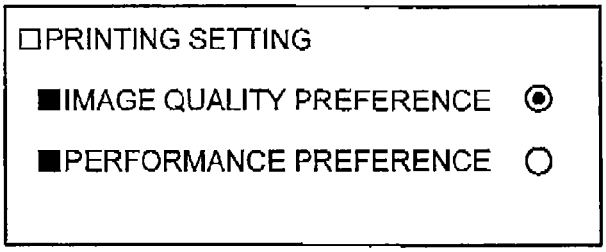
FIG. 12 is a diagram that illustrates an example of an input screen of printing settings.

FIG. 12 is a diagram that illustrates an example of the input screen of printing settings. The input screen of the printing settings displays "image quality preference" and "performance preference" as preference items in image formation such that any one thereof can be selected by a user. In addition, the input screen of printing settings may be configured such that the printing settings can be selected for each recording medium, and the setting content set on the input screen of the printing settings may be registered in the sheet information illustrated in FIG. 10.

Referring back to FIG. 9, the si3 unit 107 outputs output data that includes the color plane data of colors CMYK each having two bits after the halftone process, the clear toner plane data (first clear toner plane data and second clear toner plane data) generated by the clear processor 106, the fixing designation information indicating whether to perform the fixing process a plurality of times, and the print attribute information to the output control unit 110.

Figure 13A:
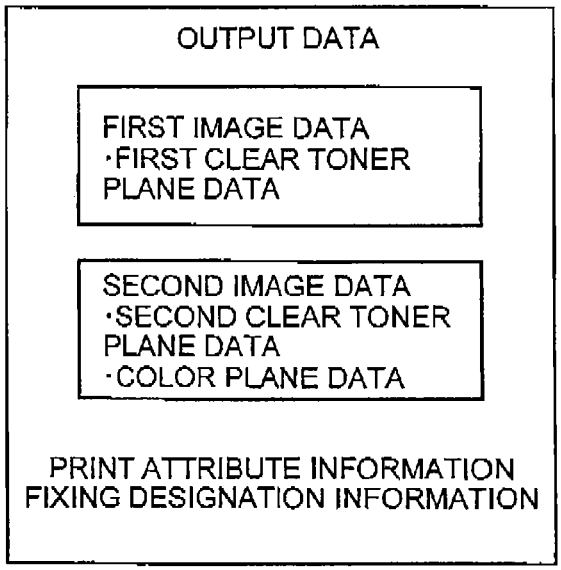
FIGS. 13A and 13B are diagrams that illustrate examples of output data.
Figure 13B:
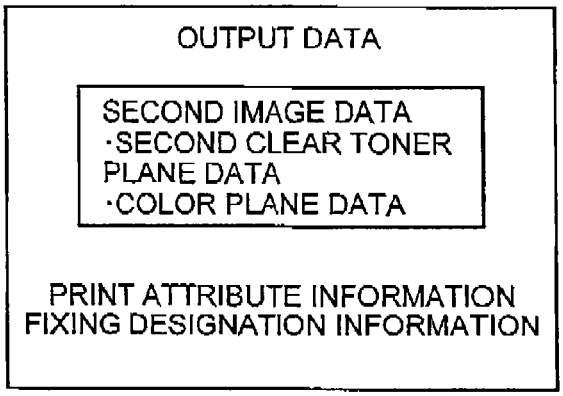

FIGS. 13A and 13B are diagrams that illustrate examples of the output data.

In a case where the clear toner plane data received from the clear processor 106 includes both the first clear toner plane data and the second clear toner plane data, the si3 unit 107 outputs the output data (see FIG. 13A) that includes the first image data, the second image data, the fixing designation information ("On") indicating that the fixing process is performed a plurality of times, and the print attribute information to the output control unit 110.

The first image data includes the first clear toner plane data. Here, as described above, the first clear toner plane data is data that defines a special color area to which the clear toner is applied for the first recording medium P1 in the fixing process of the first time (first pass). Accordingly, in other words, the first image data is data used for applying clear toner to the first recording medium P1 in the fixing process of the first time (first pass).

The second image data includes the second clear toner plane data and the color plane data received from the halftone engine 105. Here, as described above, the second clear toner plane data is data that defines a special color area to which the clear toner is applied for the recording medium P (the first recording medium P1 or the second recording medium P2) in the fixing process of the first time (first pass) or the fixing process of the second time (second pass). Accordingly, in other words, the second image data is data used for applying the clear toner and the color toner to the first recording medium P1 in the first (first pass) fixing process or data used for applying the clear toner and the color toner to the second recording medium P2 in the second (second pass) fixing process.

Here, in a case where both the first image data and the second image data are included in the output data, the si3 unit 10'7 determines that the fixing process is performed a plurality of times and outputs the output data including the fixing designation information ("On") indicating that the fixing process is performed a plurality of times to the output control unit 110. Accordingly, in a case where both the first image data and the second image data are included in the output data, the second image data is data used for applying the clear toner and the color toner to the second recording medium P2 in the second (second pass) fixing process.

On the other hand, in a case where the clear toner plane data received from the clear processor 106 does not include the first clear toner plane data but includes the second clear toner plane data, the si3 unit 107 outputs the output data (see FIG. 133) that includes: the second image data; and the fixing designation information ("Off") indicating that the fixing process is not performed a plurality of times; and the print attribute information to the output control unit 110. Here, the fixing designation information may be given to the clear processor 106 or the output control unit 110.

In other words, the si3 unit 107 outputs the output data that includes at least one of the first image data and the second image data to the output control unit 110.

Here, in a case where the output data does not include the first image data but includes the second image data, the si3 unit 107 determines that the fixing process is performed once and outputs the output data including the fixing designation information ("Off") indicating that the fixing process is not performed a plurality of times (the fixing process (first pass) is performed only once) to the output control unit 110. Accordingly, in a case where the output data does not include the first image data but includes the second image data, the second image data is data used for applying the clear toner and the color toner to the first recording medium P1 to which the clear toner has not been applied.

The si3 unit 107 outputs the output data described above to the output control unit 110 for every page unit (i.e., in units of images recorded on the same page).

Next, referring back to FIG. 9, the output control unit 110 will be described in detail.

The output control unit 110 includes: an acquisition unit 110E; a detection unit 110A; an output unit 110F; and a sheet information storing unit 1103.

The acquisition unit 110E acquires the output data from the si3 unit 107.

The detection unit 110A detects whether the acquired output data does not include the first clear toner plane data but includes the second clear toner plane data. In addition, the detection unit 110A stores the color plane data and the clear toner plane data (the first clear toner plane data and the second clear toner plane data) included in the output data in the sheet information storing unit 110B in association with a page identification number identifying the page for each page of the acquired output data.

In addition, the detection unit 110A, in association with the page identification number identifying the page, generates sheet information and stores the generated sheet information in the sheet information storing unit 110B for each page of the acquired output data.

FIG. 14 is a diagram that illustrates an example of the sheet information. The sheet information includes fixing information, print attribute information, and charge information. The fixing information includes the fixing designation information, a clear toner plane (front side) of the first time, and a clear toner plane (rear side) of the first time.

The clear toner plane (front side) of the first time indicates whether or not the first clear toner plane data used for forming an image on the front surface of the recording medium P (first recording medium P1) through the fixing process of the first time is included in the output data ("Presence" or "No Presence"). The clear toner plane (rear side) of the first time indicates whether or not the first clear toner plane data used for forming an image on the rear surface of the recording medium P (first recording medium P1) through the fixing process of the first time is included in the output data ("Presence" or "No Presence").

The charge information represents a charge count value that is used for the calculation of the charge information. In this embodiment, the charge information includes: a monochrome charge count value; a color charge count value; and a clear toner charge count value. The fixing designation information and the print attribute information have been described as above, and thus, the description thereof will not be presented here.

The sheet information storing unit 110E forms the sheet information as a list and stores the list. When the output data for each page is received from the si3 unit 107, the detection unit 110A generates the sheet information and adds the generated sheet information to the end of the list. The deletion of the sheet information is performed by a second output unit 110D to be described later.

Each time the output data for each page is received from the si3 unit 107, the detection unit 110A increments the value of the page identification number by one each time. Then, the detection unit 110A registers the fixing designation information "On" or "Off" that is included in the output data as the fixing designation information of a corresponding page identification number. In addition, the detection unit 110A registers the print attribute information included in the output information as the print attribute information of the corresponding page identification number.

In addition, in a case where the first clear toner plane data is not included in the output data, the detection unit 110A sets "No Presence" in each of the clear toner plane (front side) of the first time and the clear toner plane (rear side) of the first time of the fixing information.

On the other hand, in a case where the first clear toner plane data is included in the output data, the detection unit 110A sets "Presence" in each of the clear toner plane (front side) of the first time and the clear toner plane (rear side) of the first time of the fixing information. The detection unit 110A may set "No Presence" to the initial value for the clear toner plane (rear side) of the first time of the fixing information.

The detection unit 110A sets "0" to the each charge count value included in the charge information as the initial value. The charge count value is updated by the charge calculating unit 111.

As described above, the detection unit 110A stores the color plane data and the clear toner plane data (the first clear toner plane data and the second clear toner plane data) included in the output data in the sheet information storing unit 110B in association with the page identification number identifying the number for each page of the acquired output data. At this time, the detection unit 110A may assign a file name or a directory name that is a name in a predetermined format, which is based on the color name of each print plane, and store the color plane data and the clear toner plane data in the sheet information storing unit 110B.

Referring back to FIG. 9, the output unit 110F generates print data based on the output data acquired by the acquisition unit 110E and outputs the generated print data to the printer 30 through the MIC 20.

FIGS. 15A to 15C are diagrams that each illustrate an example of the data configuration of the print data. The print data is a collective name for the first print data, the second print data, and the third print data.

The first print data includes the first clear toner plane data and the first identification information that represents an image formation instruction for the first recording medium P1 stored in the first sheet feed tray 30C storing the first recording medium P1 (see FIG. 15A). In addition, the first print data may include the print attribute information. In such a case, the print attribute information included in the first print data includes the first identification information. In addition, the first print data may further include the fixing designation information to be described later.

The second print data includes the second clear toner plane data, the color plane data, and the second identification information that represents an image formation instruction for the second recording medium P2 stored in the second sheet feed tray 30D storing the second recording medium P2 (see FIG. 153). In addition, the second print data may include the print attribute information. In such a case, the print attribute information included in the second print data includes the second identification information. In addition, the second print data may further include the fixing designation information to be described later.

The third print data includes the second clear toner plane data, the color plane data, and the first identification information that represents an image formation instruction for the first recording medium P1 stored in the first sheet feed tray 30C storing the first recording medium P1 (see FIG. 15C). In addition, the third print data may include the print attribute information. In such a case, the print attribute information included in the third print data includes the first identification information. In addition, the third print data may further include the fixing designation information to be described later.

Referring back to FIG. 9, the output unit 110F includes a first output unit 110C and a second output unit 110D.

The first output unit 110C, in a case where the first image data is included in the output data acquired from the si3 unit 107, outputs the first print data including the first clear toner plane data and the first identification information, which represents an image formation instruction for the first recording medium P1 stored in the first sheet feed tray 30C storing the first recording medium P1, included in the first image data to the printer 30 (image forming unit).

Specifically, the first output unit 110C determines necessity/no necessity of outputting the first clear toner plane data to the first recording medium P1 based on the fixing information corresponding to the page identification number (the oldest page identification number stored in the sheet information storing unit 110B) that is designated by the detection unit 110A by referring to the sheet information stored in the sheet information storing unit 110B. When the necessity of outputting the first clear toner plane data to the first recording medium P1 is determined, the first output unit 110C outputs the first print data that includes the print attribute information corresponding to the page identification information and the first clear toner plane data corresponding to the page identification information to the printer 30.

In this embodiment, information (for example, tray 1) representing the "sheet feed tray" that is included in the print attribute information corresponds to the first identification information representing an instruction to form an image on the first recording medium P1 stored in the first sheet feed tray 30C.

In addition, the first output unit 110C transmits a display instruction to the display unit 109A or transmits the page identification information and an output instruction to the second output unit 110D through a process to be described later.

The second output unit 110D, in a case where the first image data and the second image data are included in the output data acquired from the acquisition unit 110E, outputs the second print data to the printer 30.

In addition, the second output unit 110D, in a case where the output data does not include the first image data but includes the second image data, outputs the third print data to the printer 30.

Specifically, the second output unit 110D, in a case where the output data does not include the first image data but includes the second image data, changes information (for example, tray 1) representing a "sheet feed tray" included in the print attribute information corresponding to the oldest page identification information (the page identification information that is the next image formation target) that is stored in the sheet information storing unit 1103 to the second identification information. Then, the second output unit 110D outputs the third print data that includes the second identification information, the second clear toner plane data corresponding to the page identification information, and the color plane data corresponding to the page identification information to the printer 30. Then, after the output, the second output unit 110D deletes the page identification information and the sheet information (see FIG. 14) corresponding to the page identification information from the sheet information storing unit 110B.

The charge calculating unit 111 determines a charge count value used for the calculation of the charge information in accordance with at least one of the first clear toner plane data, the color plane data, and the second clear toner plane data that are included in the output data. Described in more detail, the charge calculating unit 111 receives the page identification number and presence/no presence information that represents the presence/no presence of the image data (the first clear toner plane data, the second clear toner plane data, and the color plane data of the colors CMYK) of each print plane for each page from the detection unit 110A. The charge calculating unit 111 determines each charge count value based on the presence/no presence information of the image data of each print plane and increments the charge count value of the sheet information corresponding to the page identification number. Then, the charge calculating unit 111 updates the charge information included in the sheet information that is stored in the sheet information storing unit 110B.

The charge calculating unit 111 processes a determination condition at the time of determining the charge count value, a target charge count value, and an increment value as follows. In a case where color plane data of K (black) is present in a page corresponding to the page identification information of the calculation target in the output data, the charge calculating unit 111 increments a corresponding charge count value (monochrome) by "1". In a case where at least one of the color plane data of Y (yellow), the color plane data of M (magenta), and the color plane data of C (cyan) is present on the page, the charge calculating unit 111 increments a corresponding charge count value (color) by "1". In addition, in a case where at least one of the first clear toner plane data and the second clear toner plane data is present on the page, the charge calculating unit 111 increments a corresponding charge count value (clear), for example, by "1" in accordance with a predetermined setting. In addition, the charge calculating unit 111, for example, may set a charge for each time for the image formation performed one time (one pass) or two times (two passes) using the clear toner plane data. Then, the charge calculating unit 111 stores a result of the calculation in the sheet information storing unit 110B.

Referring back to FIG. 1, the DFE 10 outputs the print data (the first print data, the second print data, or the third print data) generated by the output control unit 110 to the printer 30 through the MIC 20.

As illustrated in FIG. 8, the control unit 30E of the printer 30 receives the print data. Then, the control unit 30E controls each unit of the printer 30 based on the received print data.

More specifically, when the first print data is received, the control unit 30E of the printer 30 performs control of each unit such that clear toner is applied to a special color area of the first recording medium P1 stored in the first sheet feed tray 30C that is defined in the first clear toner plane data included in the first print data. Accordingly, in a case where the first print data is received, the printer 30 conveys the first recording medium P1 stored in the first sheet feed tray 30C to the conveyance path 30F in accordance with an image formation instruction represented by the first identification information included in the first print data. Then, by controlling the photoconductor 30A and the like, the control unit 30E of the printer 30 applies clear toner to a special color area of the first recording medium P1 that is defined in the first clear toner plane data included in the first print data. Accordingly, the clear toner is applied and fixed to the first recording medium P1 to which the clear toner has not been applied.

The first recording medium P1 to which the clear toner has been applied is set in the second sheet feed tray 30D by the user. Accordingly, the first recording medium P1 to which the clear toner has been applied, in other words, the second recording medium P2 is stored in the second sheet feed tray 30D.

On the other hand, when the second print data is received, the control unit 30E of the printer 30 applies the clear toner to a special color area of the second recording medium P2 stored in the second sheet feed tray 30D that is defined in the second clear toner plane data and applies the color toner to a color area defined in the color plane data.

Accordingly, in a case where the second print data is received, the printer 30 conveys the second recording medium P2, for which the image formation has been completed using the clear toner, stored in the second sheet feed tray 30D to the conveyance path 30F in accordance with an image formation instruction represented by the second identification information included in the second print data. Then, by controlling the photoconductor 30A and the like, the control unit 30E of the printer 30 applies clear toner to a special color area of the second recording medium P2 that is defined in the second clear toner plane data included in the second print data. In addition, by controlling the photoconductor 30A and the like, the control unit 30E of the printer 30 applies the color toner to a color area of the second recording medium P2 that is defined in the color plane data included in the second print data.

In this case, to the recording medium P, the clear toner is applied through the fixing process (image forming process) of the first time (first pass), and the clear toner and the color toner are additionally applied through the fixing process (image forming process) of the second time (second pass).

In addition, when the third print data is received, the control unit 30E of the printer 30 applies the clear toner to a special color area of the first recording medium P1 stored in the first sheet feed tray 30C that is defined in the second clear toner plane data and applies the color toner to a color area defined in the color plane data.

Accordingly, in a case where the third print data is received, the printer 30 conveys the first recording medium P1 stored in the first sheet feed tray 300 storing the first recording medium P1 to which the clear toner has not been applied to the conveyance path 30F in accordance with an image formation instruction represented by the first identification information included in the third print data. Then, by controlling the photoconductor 30A and the like, the control unit 30E of the printer 30 applies clear toner to a special color area of the first recording medium P1 that is defined in the second clear toner plane data included in the third print data. Sri addition, by controlling the photoconductor 30A and the like, the control unit 30E of the printer 30 applies the color toner to a color area of the first recording medium P1 that is defined in the color plane data included in the third print data.

Accordingly, in the DFE 10 according to this embodiment, in a case where the fixing process is performed twice for one recording medium P (it may be referred to as a two-time image forming process or a two-pass system), in a case where the image forming process of the first time using the clear toner is not necessary, an image can be formed for the first recording medium P1 that is stored not in the second sheet feed tray 30D storing the second recording medium P2 but in the first sheet feed tray 30C. Accordingly, for a recording medium P for which the image forming process of the first time is not necessary, the image forming process of the first time can be controlled so as not to be performed.

Conventionally, also for a recording medium P for which the image forming process of the first time is not necessary, the printer 30 side is required to perform the fixing process of the first time unnecessarily conveying the recording medium P. Then, the recording medium P for which the unnecessary fixing process of the first time has been performed is set in the second sheet feed tray 30D by the user, and the image forming process of the second time is performed. Accordingly, conventionally, also for a recording medium P for which the image forming process of the first time is not necessary, a time corresponding to the two passes (a total time required for the image forming process of the first time and the image forming process of the second time). On the other hand, in the DFE 10 according to this embodiment, for a recording medium P for which the image forming process of the first time is not necessary, the image forming process of the first time can be controlled so as not to be performed. Accordingly, the image forming time can be shortened.

Figure 16:
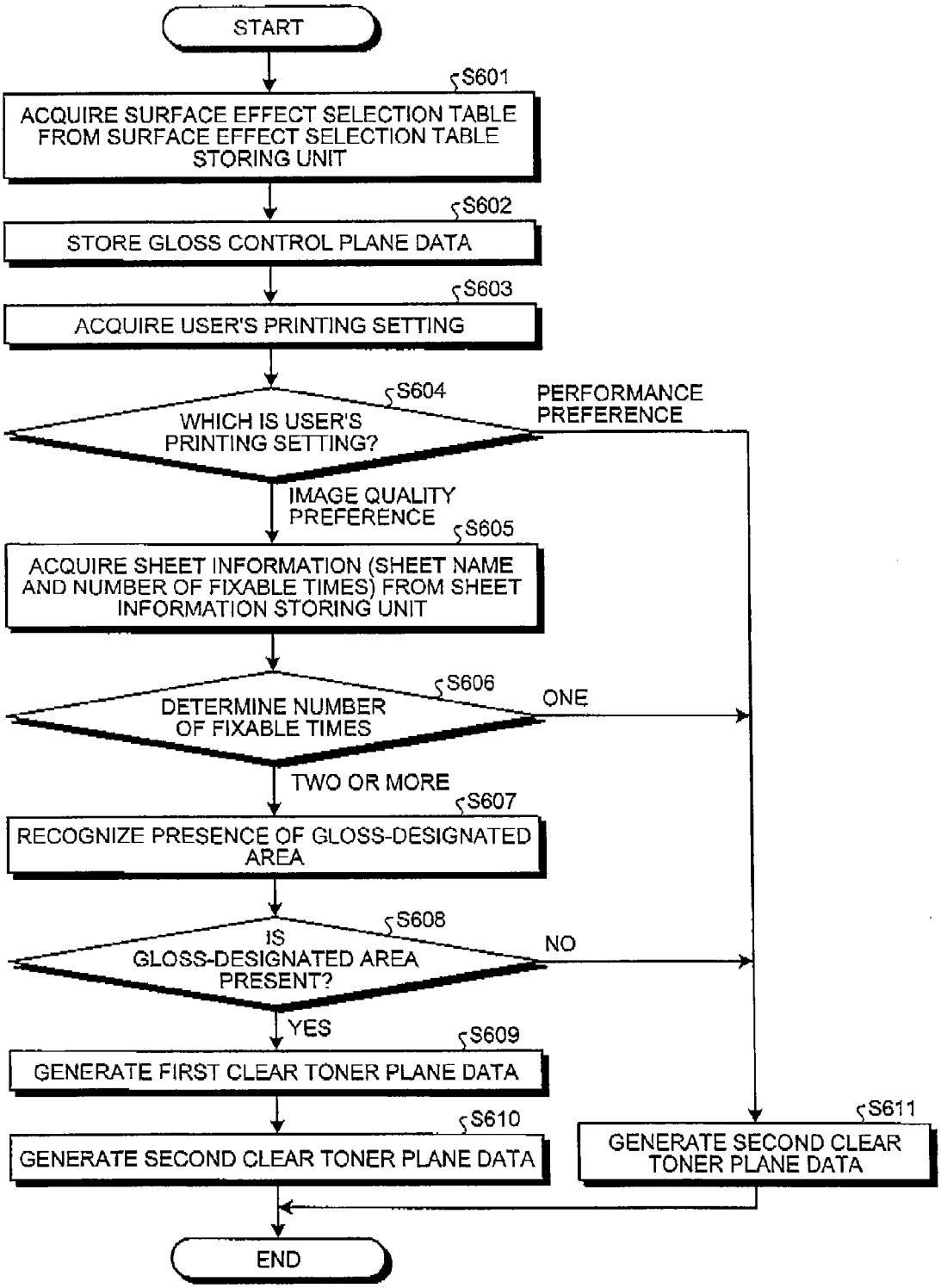
FIG. 16 is a flowchart that illustrates the sequence of a clear toner plane generating process.

Next, the sequence of a clear toner plane generating process will be described. FIG. 16 is a flowchart that illustrates the sequence of the clear toner plane generating process.

The clear toner plane generating unit 106C acquires the surface effect selection table from the surface effect selection table storing unit 106B (step S601). In addition, the clear toner plane generating unit 106C stores input gloss control plane data in the gloss control plane storing unit 106A (step S602).

Next, the fixing condition determining unit 106E acquires a printing setting ("image quality preference" or "performance preference") according to the user from the input/output control unit 108 (step S603) and determines the user's printing setting (step S604). In a case where the user's printing setting is the "image quality preference", the process proceeds to step S605. Then, the fixing condition determining unit 106E acquires the sheet information (the sheet name and the number of fixable times) of the image formation target from the sheet information storing unit 106D (step S605). For example, the fixing condition determining unit 1065 reads the sheet name and the sheet size included in the print attribute information acquired from the sit unit 102, and the fixing condition determining unit 106E reads, from the sheet information (see FIG. 10), the number of fixable times corresponding to the sheet name and the sheet size that have been read, thereby acquiring the sheet information.

Next, the fixing condition determining unit 106E determines the number of fixable times (step S606). In a case where the number of fixable times acquired in step S605 is two times or more, the fixing condition determining unit 106E notifies the clear toner plane generating unit 106C of the determination result (the number of fixable times: two times or more). When the notification is received from the fixing condition determining unit 106E, the clear toner plane generating unit 1060 checks whether an area for which the gloss is designated is present in the gloss control plane data (step S607).

Here, in the gloss control plane data, areas for which density values (238 to 255, density (%)=94%, 96%, and 98%) corresponding to the "specular gloss types A to C" in the surface effect selection table acquired in step S601 are set are gloss-designated areas. Areas for which density values (212 to 232, density (%)=84%, 86%, 88%, and 90%) are set may be included in the gloss-designated areas. Accordingly, in a case where an area for which the density value is set is present in the gloss control plane data, the clear toner plane generating unit 106C determines that the gloss-designated area is present in the gloss control plane data.

In a case where a gloss-designated area is present in the gloss control plane data (Yes in step S608), the clear toner plane generating unit 106C, first, generates the clear toner plane data of only the gloss-designated areas for which the density values corresponding to the "specular gloss types A to C" are set as the first clear toner plane data (step S609). This first clear toner plane data is used for applying only the clear toner to the gloss-designated areas. Next, the clear toner plane generating unit 106C generates the clear toner plane data including the gloss-designated areas and areas other than the gloss-designated areas as the second clear toner plane data (step S610). The second clear toner plane data is data used for applying the clear toner according to the kind of the surface effect defined in the gloss control plane data to all the areas of the recording medium P.

In this way, the reason for the clear toner plane generating unit 106C to generate two pieces of the clear toner plane data of the first clear toner plane data of only the gloss-designated areas acquired in step S609 and the second clear toner plane data including the gloss-designated areas and areas other than the gloss-designated areas acquired in step S610 is as follows.

In step S609, by generating the first clear toner plane data of only the gloss-designated areas, the printer 30 can form a clear toner image used for absorbing the unevenness of the recording medium P (more specifically, the first recording medium P1) in the fixing process (first pass) of the first time based on the first clear toner plane data generated in step S609. In order to apply the surface effect of the gloss, it is necessary for the surface of the recording medium P to be smooth, and accordingly, by performing the above-described process, the surface effect of the gloss is acquired for the first recording medium P1.

Then, in step S610, the second clear toner plane data is generated. Accordingly, the printer 30, in the fixing process (second pass) of the second time, can form a clear toner image according to the second clear toner plane data of both the gloss-designated areas and the areas other than the gloss-designated areas on the recording medium P (in other words, the second recording medium P2 to which the clear toner has been applied) that is smoothed by absorbing the unevenness of the first recording medium P1. Accordingly, the printer 30 improves the glossiness of the specular gloss according to the gloss process, and the surface effect of the specular gloss can be applied.

On the other hand, in a case where the user's printing setting is determined to be the "performance preference" in step S604 described above or in a case where the number of fixable times is "1" in step S606, the fixing condition determining unit 106E notifies the clear toner plane generating unit 106C of the determination result (the number of fixable times is "1").

The clear toner plane generating unit 106C receives the notification from the fixing condition determining unit 106E and generates the second clear toner plane data based on the gloss control plane data and the color plane data (step S611). In this case, the clear toner plane generating unit 1060 generates a single piece of the second clear toner plane data instead of generating two pieces of the clear toner plane data (the first clear toner plane data and the second clear toner plane data) as in steps S609 and S610. The second clear toner plane data, as described above, is data that is used for applying clear toner according to the kind of the surface effect defined in the gloss control plane data to all the areas of the recording medium P.

In addition, in step S608, in a case where a gloss-designated area is not present in the gloss control plane data (No in step S608), the clear toner plane generating unit 106C generates a single piece of the second clear toner plane data based on the gloss control plane data (step S611).

When the clear toner plane data is generated by the clear processor 106, the si3 unit 107 outputs output data that includes the clear toner plane data (the first clear toner plane data and the second clear toner plane data) generated in step S609, S610, or S611, the color plane data of the colors CMYK each having two bits after the halftone process, the fixing designation information representing whether to perform the fixing process a plurality of times, and the print attribute information to the output control unit 110.

Here, in a case where the user's printing setting is the "image quality preference", and the number of fixable times is "two or more", the si3 unit 107 sets the fixing designation information as "On". On the other hand, in a case where the user's printing setting is the "performance preference" or in a case where the user's printing setting is the "image quality preference" and the number of fixable times is "1", the si3 unit 107 sets the fixing designation information as "Off".

Figure 17:
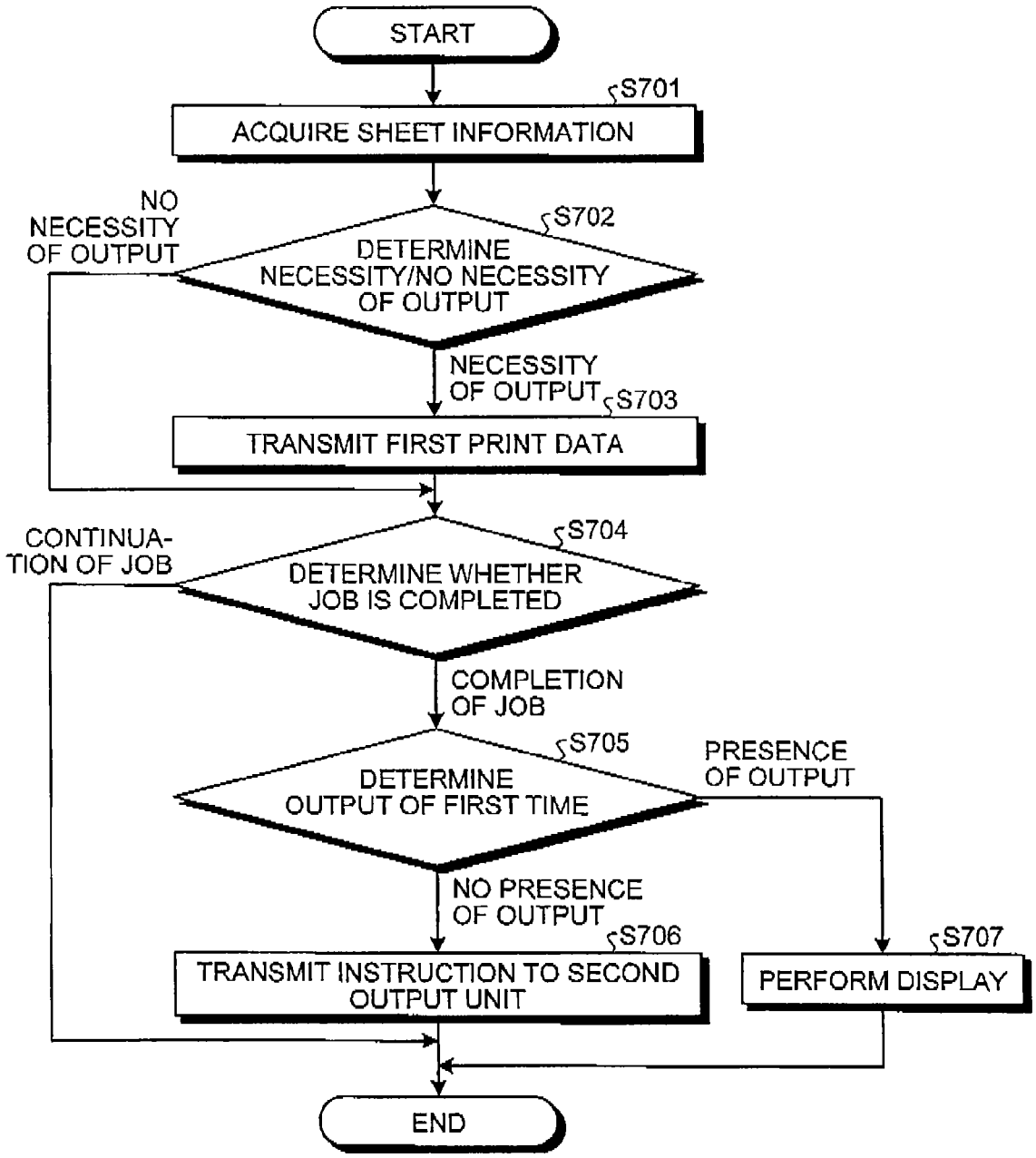
FIG. 17 is a flowchart that illustrates the processing sequence of a first output unit at the time of receiving an output instruction.

Next, the processing sequence of the first output unit 110C will be described. FIG. 17 is a flowchart that illustrates the processing sequence of the first output unit 110C at the time of receiving an output instruction. First, the first output unit 110C receives the page identification number of a page that is the image formation target and the output instruction from the detection unit 110A. In addition, the detection unit 110A transmits page identification information corresponding to the first (oldest; first-registered) sheet information among the page identification information stored in the sheet information storing unit 110B to the first output unit 110C. Then, the first output unit 110C acquires sheet information corresponding to the received page identification number from the sheet information storing unit 110B (step S701).

The first output unit 110C determines the necessity/no necessity of the fixing process of the first time (first pass) (necessity/no necessity of output) for the recording medium P based on the values of the clear toner plane (front side) of the first time and the clear toner plane (rear side) of the first time of the acquired sheet information (step S702). In step S702, in a case where the values of both the clear toner plane (front side) of the first time and the clear toner plane (rear side) of the first time of the acquired sheet information are "No Presence", the first output unit 110C determines "no necessity of output" (in other words, no necessity of the fixing process of the first time (first pass)). On the other hand, in a case where at least one of them is "Presence", the first output unit 110C determines "necessity of output" (in other words, the necessity of the fixing process of the first time (first pass)). In addition, the first output unit 110C may determine "no necessity of output" in a case where the fixing designation information included in the acquired sheet information is "Off" and determine "necessity of output" in a case where the fixing designation information is "On".

In a case where the "necessity of output" is determined, the first output unit 110C transmits the first print data to the MIC 20 based on the sheet information acquired in step S701. As described above, the first print data includes the first clear toner plane data and the print attribute information.

Specifically, the first output unit 110C outputs the first print data that includes the first clear toner plane data corresponding to the sheet information acquired in step S701 and the print attribute information included in the sheet information acquired in step S701 to the MIC 20 (step S703). More specifically, the print attribute information includes the first identification information that represents an image formation instruction for the first recording medium P1 stored in the first sheet feed tray 30C storing the first recording medium P1. In addition, as described above, in this embodiment, the information (for example, tray 1) representing the "sheet feed tray" included in the print attribute information corresponds to the first identification information that represents an image formation instruction for the first recording medium P1 stored in the first sheet feed tray 30C.

Next, the first output unit 110C refers to the value of the job start/end that is included in the sheet information acquired in step S701 as the print attribute information and determines "job end" in the case of "end". Otherwise, the first output unit 110C determines "job continuation" (step S704). In the case where "job continuation" is determined, the first output unit 110C ends this routine. On the other hand, in a case where "job end" is determined, the first output unit 110C causes the process to proceed to step S705.

In addition, the first output unit 110C sets the sheet information acquired in step S701 as the starting point and repeats a process of acquiring previous sheet information until the value of the job start/end of newly acquired sheet information becomes the "start". In this way, the sheet information corresponding to one job can be acquired. Then, in the next step of step S705, the first output unit 110C performs an output determination of the first time by referring to the values of the clear toner plane (front side) of the first time and the clear toner plane (rear side) of the first time of all the sheet information corresponding to one job. In other words, the first output unit 110C determines whether or not a page that is necessary for the fixing process (image forming process) of the first time (first pass) is included within one job. Accordingly, the first output unit 110C can determine the presence/no presence of the image forming process of the first time in units of jobs.

In a case where the values of the clear toner plane (front side) of the first time and the clear toner plane (rear side) of the first time of all the sheet information that have been referred to are "no presence", the first output unit 110C determines "no presence of output". Otherwise, the first output unit 110C determines "presence of output" (step S705). In a case where the "no presence of output" is determined, the first output unit 110C transmits the page identification information and the output instruction received from the detection unit 110A to the second output unit 110D (step S706). Accordingly, in a case where a page that is necessary for the fixing process of the first time (first pass) is not included within the job, the image forming apparatus 100 can start the fixing process (image formation process) of the second time (second pass) without any user's intervention.

In a case where the "presence of output" is determined in step S705, the first output unit 110C displays a message urging to set the recording medium P (in other words, the second recording medium P2) to which the clear toner has been applied through the fixing process (image forming process) of the first time in the second sheet feed tray 30D such as the manual feed tray and an instruction button for giving an instruction for executing the fixing process (image forming process) of the second time on the display unit 109A (step S707). Then, this routine ends. The user checks the message displayed on the display unit 109A, sets the recording medium P (in other words, the second recording medium P2) to which the clear toner has been applied through the fixing process of the first time in the second sheet feed tray 30D such as a manual feed tray, and gives an instruction for the instruction button by operating the input unit 1093. When the instruction according to the instruction button is input, the output control unit 110 transmits the page identification information and the output instruction received from the detection unit 110A to the second output unit 110D.

Figure 18:
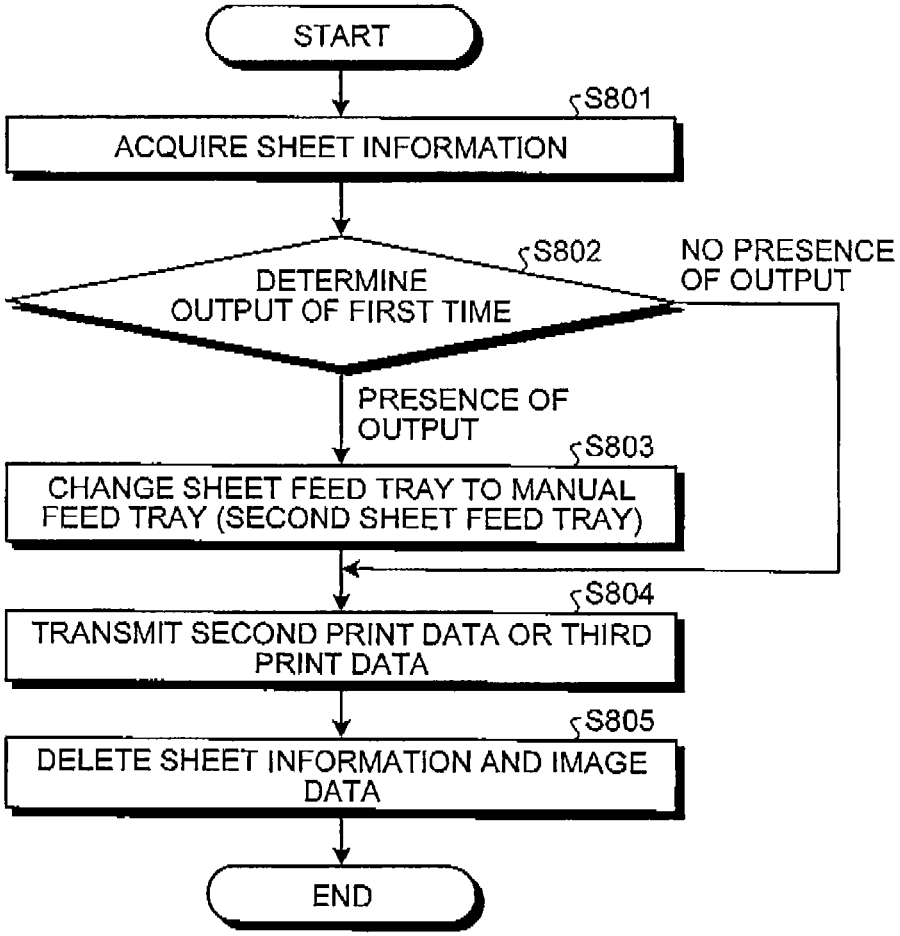
FIG. 18 is a flowchart that illustrates the processing sequence of a second output unit at the time of receiving an output instruction.

Next, the processing sequence of the second output unit 110D will be described. FIG. 18 is a flowchart that illustrates the processing sequence of the second output unit 110D.

The second output unit 110D receives the page identification number and the output instruction from the input unit 109B or the first output unit 110C. Then, the second output unit 110D acquires sheet information corresponding to the received page identification number of the sheet information stored in the sheet information storing unit 110B (step S801).

The second output unit 110D determines whether the fixing process of the first time (first pass) for the recording medium P is performed (an output determination of the first time) based on the values of the clear toner plane (front side) of the first time and the clear toner plane (rear side) of the first time of the acquired sheet information (step S802). In step S802, in a case where the values of both the clear toner plane (front side) of the first time and the clear toner plane (rear side) of the first time of the acquired sheet information are "No Presence", the second output unit 110D determines "no presence of output" (in other words, the fixing process of the first time (first pass) is not performed). Otherwise, the second output unit 110D determines "presence of output" (in other words, there is the fixing process of the first time (first pass)). In addition, the second output unit 110D may determine "no presence of output" in a case where the fixing designation information included in the acquired sheet information is "Off" and determine "presence of output" in a case where the fixing designation information is "On".

In a case where the "presence of output" is determined in step S802, the second output unit 110D causes the process to proceed to step S803 and changes the value of the sheet feed tray included in the print attribute information included in the acquired sheet information to the second sheet feed tray 30D (for example, the "manual feed tray") (step S803). Then, the process proceeds to step S804.

On the other hand, in a case where the "no presence of output" is determined in step S802, the second output unit 110D causes the process to proceed to step S804.

Next, the second output unit 110D generates the second print data or the third print data based on the sheet information acquired in step S801 and transmits the generated print data to the MIC 20.

In a case where the "presence of output" is determined in step S802, the second output unit 110D transmits the second print data to the MIC 20. On the other hand, in a case where the "no presence of output" is determined in step S802, the second output unit 110D transmits the third print data to the MIC 20 (step S804).

As described above, the second print data includes: the second clear toner plane data; the color plane data; and the print attribute information in which the value of the sheet feed tray is changed to the second identification information. The second print data may further include the charge information that is included in the sheet information. This second identification information represents an image formation instruction for the second recording medium P2 that is stored in the second sheet feed tray 30D (manual feed tray).

Specifically, in a case where the "presence of output" is determined in step S802, the second output unit 110D transmits the second print data that includes the second clear toner plane data corresponding to the sheet information acquired in step S801, the color plane data corresponding to the sheet information, and the print attribute information acquired by changing the "sheet feed tray" to the second identification information described above in the print attribute information included in the sheet information acquired in step S801 to the printer 30 through the MIC 20.

In addition, the third print data includes the second clear toner plane data, the color plane data, and the print attribute information including the first identification information. In addition, charge information may be further included in the third print data. The first identification information represents an image formation instruction for the first recording medium P1 that is stored in the first sheet feed tray 30C storing the first recording medium P1 and corresponds to a value that is represented in the "sheet feed tray" included in the print attribute information.

In a case where the "no presence of output" is determined in step S802, the second output unit 110D transmits the third print data that includes: the second clear toner plane data corresponding to the sheet information acquired in step S801, the color plane data corresponding to the sheet information, and the print attribute information (including the first identification information) included in the sheet information acquired in step S801 to the printer 30 through the MIC 20.

Next, the second output unit 110D deletes the sheet information acquired in step S801, the page identification number corresponding to the sheet information, and all the image data (the first clear toner plane data, the second clear toner plane data, and the color plane data) corresponding to the page identification number from the sheet information storing unit 110E (step S805). As above, this process ends.

In addition, the second sheet feed tray 30D storing the second recording medium P2 may be configured to be selectable or changeable by the user through the input unit 109*g*. In such a case, the DFE 10 may display a list of sheet feed trays mounted in the printer 30 to be selectable on the display unit 109A. Then, the user may select the sheet feed tray carrying the second recording medium P2 to which the clear toner has been applied from the list of the sheet feed trays displayed on the display unit 109A by operating the input unit 109B. The DFE 10 sets the selected sheet feed tray as the second sheet feed tray 30D and may use the selected sheet feed tray as the second identification information that represents an image formation instruction for the second recording medium P2 stored in the second sheet feed tray 30D.

In addition, when the output unit 110F performs the output process illustrated in FIGS. 17 and 18, the first output unit 110C performs control of the printer 30 such that the clear toner is applied to the first recording medium P1 stored in the first sheet feed tray 30C (tray 1) for pages identified by the page identification numbers "10001", "10003", and "10004" in the fixing process (first pass) of the first time.

After the completion of the image formation of the first time (first pass) that is performed by the printer 30, the user sets the recording medium P (in other words, the second recording medium P2) in the second sheet feed tray 30D (for example, the manual feed tray) in accordance with the display of the display unit 109A. Then, when the user gives an instruction for performing image formation of the second time by operating the input unit 109B, the image forming process (fixing process) of the second time (second pass) is started in the printer 30. In the image forming process of the second time, the control of the printer 30 is performed such that the second output unit 110D conveys a recording medium P (the first recording medium P1 or the second recording medium P2) from the second sheet feed tray 30D (for example, the manual feed tray) for the page of which the page identification number is 10001, from the first sheet feed tray 300 (for example, tray 1) for the page of which the page identification number is 10002, from the second sheet feed tray 30D (for example, the manual feed tray) for the page of which the page identification number is 10003, from the second sheet feed tray 30D (the manual feed tray) for the page of which the page identification number is 10004, and from the first sheet feed tray 30C (tray 1) for a sheet of which the page identification number is 10005, and an image is formed on the conveyed recording medium P.

Then, when the first print data is received, the control unit 30E of the printer 30 performs control of each unit such that the clear toner is applied to a special color area of the first recording medium P1 stored in the first sheet feed tray 30C that is defined in the first clear toner plane data included in the first print data. In addition, when the second print data is received, the control unit 30E of the printer 30 applies the clear toner to a special color area of the second recording medium P2 stored in the second sheet feed tray 30D that is defined in the second clear toner plane data and applies the color toner to a color area defined in the color plane data. Furthermore, when the third print data is received, the control unit 30E of the printer 30 applies the clear toner to a special color area of the first recording medium P1 stored in the first sheet feed tray 30C that is defined in the second clear toner plane data and applies the color toner to a color area defined in the color plane data.

Accordingly, in the image forming apparatus 100 according to this embodiment, in a case where the fixing process is performed twice for one recording medium P (it may be referred to as a two-time image forming process or a two-pass system), in a case where the image forming process of the first time using the clear toner is not necessary, an image can be formed for the first recording medium P1 stored not in the second sheet feed tray 30D storing the second recording medium P2 but in the first sheet feed tray 30C.

Here, conventionally, in a case where the image forming process of the two pass system is performed using the printer 30, also for a recording medium P for which the image forming process of the first time is not necessary, the image forming process of the second time is performed. Accordingly, a time required for the image forming process for the recording medium P for which the image forming process of the first time is not necessary is wasted.

On the other hand, according to the image forming apparatus 100 of this embodiment, in a case where the two-time fixing process is performed, in a case where the image formation of the first time using the clear toner is not necessary, an image is formed on the first recording medium P1 stored not in the second sheet feed tray 30D storing the second recording medium P2 but in the first sheet feed tray 30C. Accordingly, for the recording medium P for which the image formation of the first time is not necessary, the image formation of the first time can be controlled so as not to be performed. Accordingly, the time required for the image formation can be shortened.

More specifically, in a case where the sheet information illustrated in FIG. 14 is stored in the sheet information storing unit 1103, for pages of which the page identification numbers are "10002" and "10005", the image forming process of the first time is not performed, and accordingly, compared to a conventional case, a printing time corresponding thereto can be shortened.

Therefore, according to the image forming apparatus 100 of this embodiment, also in a case where printing is performed for a recording medium a plurality of times, an image can be formed in an efficient manner.

In other words, the printer 30 forms an image by performing switching between the second recording medium P2 to which the clear toner has been applied and the first recording medium P1 to which the clear toner has not been applied in accordance with the second clear toner plane data, the color plane data, and the print attribute information (including the first identification information or the second identification information) included in the second print data or the third print data.

In accordance with the completion of the image forming process of the second time that is performed by the printer 30, a user can acquire a recording medium P on which a desired image is formed.

In addition, instead of the clear toner, the above-described metallic toner may be used. In order to acquire a desired image using the image forming apparatus 100, also in a case where, after a ground is generated by forming an image using the metallic toner, an image is formed using one or more of the color toner of the colors CMYK and the metallic toner, similarly, the image forming process needs to be performed twice. As above, in an image forming system in which an image is formed using metallic toner in the image forming process of the first time, and an image is formed using one or more of the color toner of the colors CMYK and the metallic toner in the image forming process of the second time, in a case where a page for which the image forming process of the first time is not necessary is included in the job, by applying the above-described output control unit 110, compared to a conventional case, a time required for the job can be shortened.

In addition, the special color toner may be white toner. In a case where the special color toner is the white toner, for example, even in a case where the recording medium P is in a thick color, the colors of a color image can be appropriately reproduced.

Second Embodiment

In the first embodiment, while the print data generating process is configured to be performed by the DFE 10, the present invention is not limited thereto.

Any one of the plurality of processes performed by one apparatus may be configured to be performed by one or more other apparatuses connected to the apparatus through a network.

As an example, in an image forming system according to a second embodiment, some of the functions of the DFE are mounted on a server apparatus on a network.

Figure 19:
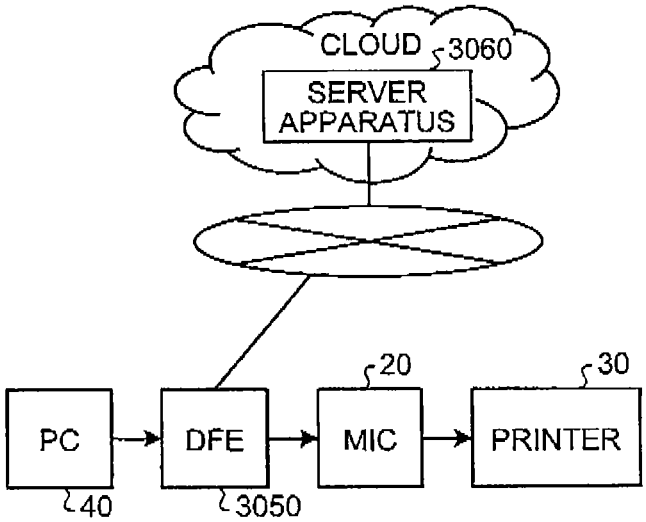
FIG. 19 is a diagram that illustrates an example of the configuration of an image forming system according to a second embodiment.

FIG. 19 is a diagram that illustrates an example of the configuration of the image forming system according to the second embodiment. As illustrated in FIG. 19, the image forming system according to the second embodiment includes: a PC 40; a DEE 3050; an MIC 20; a printer 30; and a server apparatus 3060 on a cloud.

In the second embodiment, the DFE 3050 and the server apparatus 3060 are interconnected through a network such as the Internet. In addition, in the second embodiment, some of the functions of the output control unit 110 of the DFE 10 according to the first embodiment are configured to be arranged in the server apparatus 3060.

Here, the connection configuration of the PC 40, the DFE 3050, the MIC 20, and the printer 30 are substantially the same as that of the first embodiment.

More specifically, in the second embodiment, the DFE 3050 is connected to a single server apparatus 3060 through a network (cloud) such as the Internet, and the server apparatus 3060 is configured to perform a print data generating process.

Figure 20:
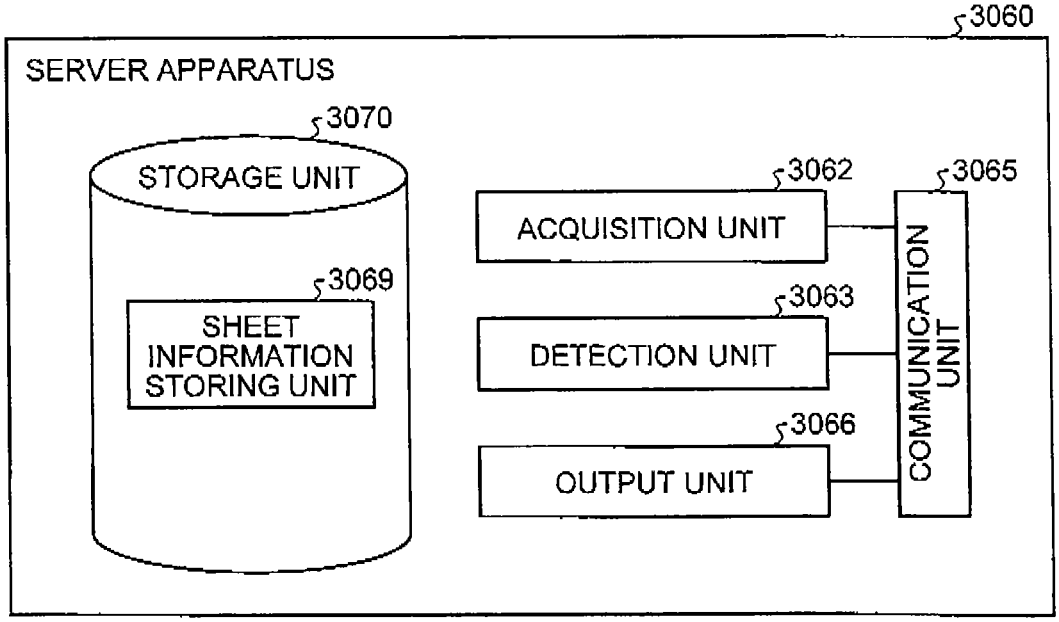
FIG. 20 is a block diagram that illustrates the functional configuration of a server apparatus according to the second embodiment.

FIG. 20 is a block diagram that illustrates the functional configuration of the server apparatus 3060 according to the second embodiment. The server apparatus 3060, as illustrated in FIG. 20, mainly, includes a storage unit 3070, an acquisition unit 3062, a detection unit 3063, an output unit 3066, and a communication unit 3065.

The storage unit 3070 is a storage medium such as an HDD or a memory and includes a sheet information storing unit 3069. The sheet information storing unit 3069 corresponds to the sheet information storing unit 110B illustrated in FIG. 9.

The communication unit 3065 transmits/receives various kinds of data and various requests to/from the DFE 3050. The acquisition unit 3062, the detection unit 3063, and the output unit 3066 are respectively similar to the acquisition unit 110E, the detection unit 110A, and the output unit 110F illustrated in FIG. 9.

Referring back to FIG. 19, the DFE 3050 has the same configuration as that of the DFE 10 according to the first embodiment 1 except for the configuration in which the output control unit 110 is configured to be included in the server apparatus 3060.

Figure 21:
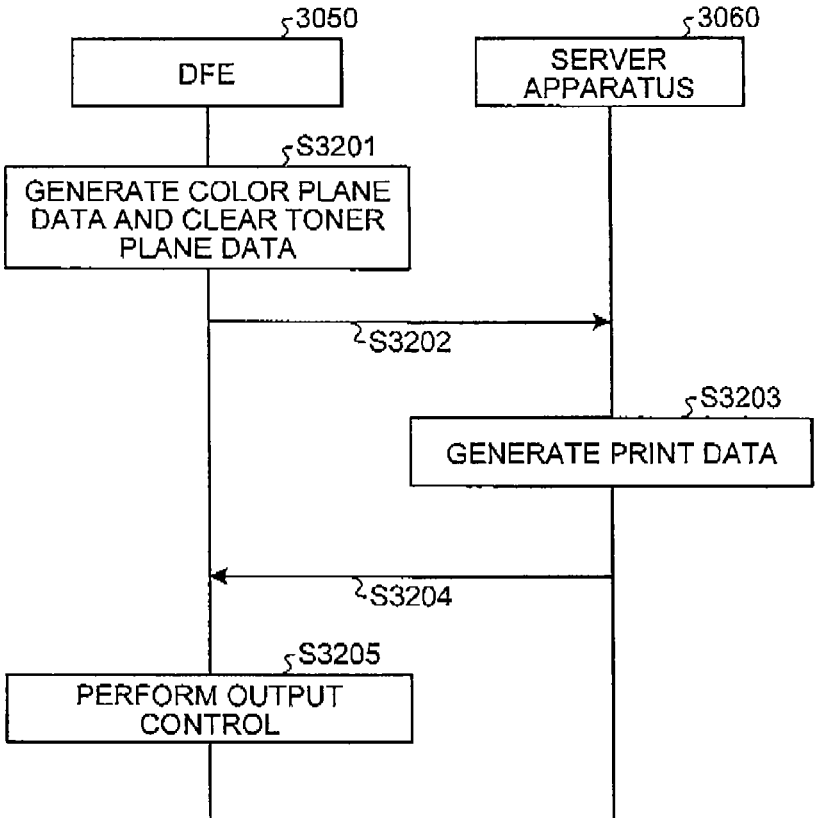
FIG. 21 is a sequence diagram that illustrates the flow of an output process according to the second embodiment.

Next, the output process performed by the image forming system according to the second embodiment configured as above will be described. FIG. 21 is a sequence diagram that illustrates the flow of the output process according to the second embodiment.

First, similarly to the DFE 10 according to the first embodiment, the DEE 3050 generates color plane data of the colors CMYK each having two bits and clear toner plane data (first clear toner plane data and second clear toner plane data) of two bits (step S3201). Next, the DFE 3050 transmits output data that includes the color plane data of the colors CMYK each having two bits, the clear toner plane data (the first clear toner plane data and the second clear toner plane data), fixing designation information representing whether to perform the fixing process a plurality of times, and print attribute information to the server apparatus 3060 (step S3202).

In the server apparatus 3060, the acquisition unit 3062, the detection unit 3063, the output unit 3066, and the sheet information storing unit 3069 respectively have the same functions as those of the acquisition unit 110E, the detection unit 110A, the output unit 110F, and the sheet information storing unit 110B of the first embodiment and perform processes similar to those of the first embodiment, thereby generating print data (step S3203). Then, the server apparatus 3060 transmits the generated print data to the DFE 3050 (step S3204).

The DFE 3050, similarly to the first embodiment, performs output control for outputting the received print data to the printer 30 through the MIC 20 (step S3205). Then, this process ends.

As above, according to the second embodiment, since the print data generating process is performed by the server apparatus 3060 disposed on the cloud, in addition to the advantages of the first embodiment, even in a case where a plurality of the DFE's 3050 are present, the print data can be generated together.

In the second embodiment, while the print data generating process is configured to be performed by disposing the acquisition unit 3062, the detection unit 3063, the output unit 3066, and the sheet information storing unit 3069 in the single server apparatus 3060 disposed on the cloud, the present invention is not limited thereto.

For example, it may be configured such that two or more server apparatuses are disposed on the cloud, and each process described above is performed by the two or more server apparatuses in a distributed manner.

Figure 22:
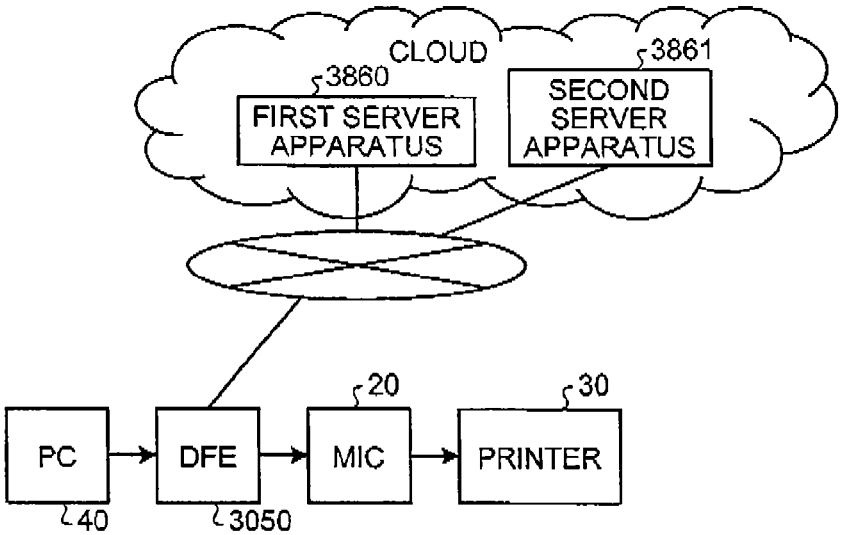
FIG. 22 is a network configuration diagram in which two server apparatuses are arranged on a cloud.

FIG. 22 is a network configuration diagram in which two server apparatuses (a first server apparatus 3860 and a second server apparatus 3861) are arranged on the cloud. In the example represented in FIG. 22, the first server apparatus 3860 and the second server apparatus 3861 are configured to perform the print data generating process in a distributed manner. In addition, the form of the distribution of each process to each server apparatus may be arbitrarily configured.

In a case where a minimal configuration is arranged in the DFE 3050, some or all of the acquisition unit 3062, the detection unit 3063, the output unit 3066, and the sheet information storing unit 3069 may be arbitrarily disposed to be centralized in one server apparatus arranged on the cloud or to be distributed to a plurality of server apparatuses.

In other words, similarly to the example described above, any one of a plurality of processes performed by one apparatus may be configured to be performed by one or more other apparatuses connected to the one apparatus through a network.

In addition, in the case of the "configuration in which any one of a plurality of processes is performed by one or more other apparatus connected to the one apparatus through the network", data input/output processes performed between one apparatus and the other apparatuses and among the other apparatuses such as a process of outputting data (information) generated by the process performed by the one apparatus from the one apparatus to the other apparatuses and a process of receiving the data in the other apparatuses are configured to be included.

In other words, in a case where there is one apparatus other than the one apparatus, a data input/output process performed between the one apparatus and the another apparatus is configured to be included. On the other hand, in a case where there are two or more of the other apparatuses, data input/output processes between the one apparatus and the other apparatuses and between the other apparatuses such as a first other apparatus and a second other apparatus are configured to be included.

In addition, in the second embodiment, while the server apparatus 3060 or a plurality of server apparatuses such as the first and second server apparatuses 3860 and 3861 are arranged on the cloud, the present invention is not limited thereto. For example, the server apparatus 3060 or a plurality of server apparatuses such as the first and second server apparatuses 3860 and 3861 may be configured to be arranged on any network such as an intranet.

Figure 23:
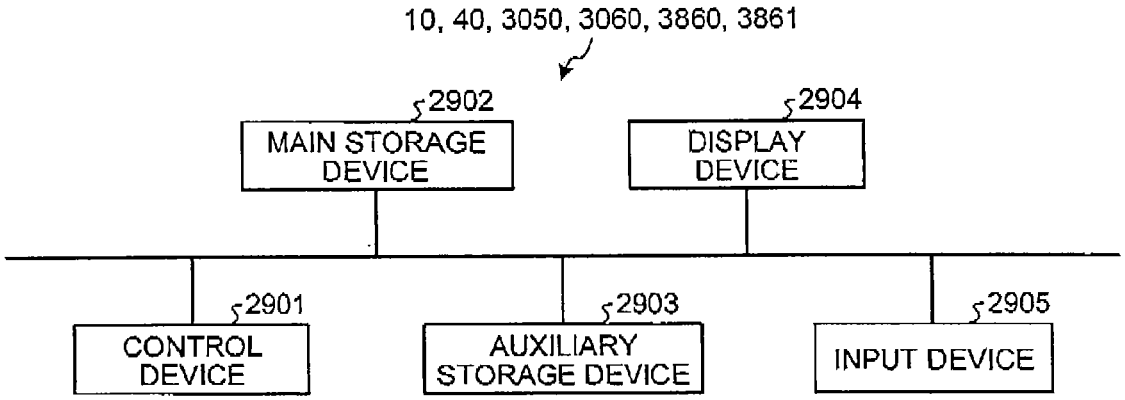
FIG. 23 is a hardware configuration diagram of a PC, a DFE, and a server apparatus.

The hardware configurations of the PC 40, the DFE's 10 and 3050, the server apparatus 3060, the first server apparatus 3860, and the second server apparatus 3861 in the above-described embodiment will be described. FIG. 23 is a hardware configuration diagram of the PC 40, the DFE's 10 and 3050, and the server apparatuses 3060, 3860, and 3861. Each of the PC 40, the DFE's 10 and 3050, and the server apparatuses 3060, 3860, and 3861, as the hardware configuration, mainly, includes: a control device 2901 such as a CPU that controls the entire apparatus; a main storage device 2902 such as a ROM or a RAM that stores various kinds of data and various programs; an auxiliary storage device 2903 such as an HDD that stores various kinds of data and various programs; an input device 2905 such as a keyboard or a mouse; and a display device 2904 such as a display and has a hardware configuration using an ordinary computer.

A program used for performing various processes performed by the DFE's 10 and 3050 and the server apparatuses 3060, 3860, and 3861 according to the above-described embodiments is recorded in a computer-readable recording medium such as a CD-ROM, a flexible disk (FD), a CD-R, or a DVD (Digital Versatile Disk) as a file of an installable format or an executable format and is provided as a computer program product.

In addition, the program used for performing various processes performed by the DFE's 10 and 3050 and the server apparatuses 3060, 3860, and 3861 according to the above-described embodiments may be configured to be stored on a computer connected to a network such as the Internet and be provided by being downloaded through the network. Furthermore, the program used for performing various processes performed by the DFE 10 according to the above-described embodiment may be configured to be provided or distributed through a network such as the Internet.

Furthermore, the program used for performing various processes performed by the DFE's 10 and 3050 and the server apparatuses 3060, 3860, and 3861 according to the above-described embodiments may be configured to be provided with being embedded into a ROM or the like in advance.

The program used for performing various processes performed by the DFE's 10 and 3050 and the server apparatuses 3060, 3860, and 3861 according to the above-described embodiments has a module configuration including each unit (the acquisition unit, the detection unit, and the output unit (the first output unit and the second output unit)) described above. As actual hardware, the CPU (processor) reads the program from the recording medium and executes the read program, and accordingly, each unit described above is loaded into the main storage device, whereby the acquisition unit, the detection unit, and the output unit (the first output unit and the second output unit) are generated on the main storage device.

In addition, the various processes performed by the DFE's 10 and 3050 and the server apparatuses 3060, 3860, and 3861 according to the above-described embodiments may be implemented not only by hardware but also by a program as software. In such a case, the program used for performing the various processes performed by the DFE's 10 and 3050 and the server apparatuses 3060, 3860, and 3861 according to the above-described embodiments is provided with being embedded in a ROM or the like in advance.

In the above-described embodiments, while the image forming system is configured to include the PC, the DFE, the MIC, and the printer, the present invention is not limited thereto. For example, the image forming system may be formed as an image forming apparatus that further includes other devices.

In addition, while the image forming system according to the above-described embodiment is configured to include the MIC 20, the present invention is not limited thereto. Thus, the process performed by the MIC 20 and the functions of the MIC 20 described above may be configured to be implemented in the other devices such as the DFE 10, and a configuration in which the MIC 20 is not arranged may be employed.

According to the present invention, it is possible to efficiently form an image even in a case where a plurality of times of printing is performed for a recording medium is acquired.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an acquisition unit configured to acquire output data that includes at least one of first image data and second image data, the first image data including first clear toner plane data that defines a special color area to which special color toner is applied for a first recording medium to which the special color toner has not been applied, the second image data including color plane data and second clear toner plane data, the color plane date defining a color area to which color toner is applied for the first recording medium or a second recording medium to which the special color toner has been applied, the second clear toner plane data defining a special color area to which the special color toner is applied for the first recording medium or the second recording medium;

a first output unit configured to output, when the output data includes the first image data, first print data that includes the first clear toner plane data and first identification information representing an instruction to form an image on the first recording medium stored in a first sheet feed tray that stores the first recording medium to an image forming unit; and a second output unit configured to output, when the output data includes the first image data and the second image data, second print data that includes the second clear toner plane data, the color plane data, and second identification information representing an instruction to form an image on the second recording medium stored in a second sheet feed tray that stores the second recording medium to the image forming unit, and to output, when the output data does not include the first image data but includes the second image data, third print data that includes the second clear toner plane data, the color plane data, and the first identification information to the image forming unit.

2. The image forming apparatus according to claim 1, wherein when the image forming unit receives the first print data, the image forming unit applies the special color toner to the special color area of the first recording medium stored in the first sheet feed tray that is defined in the first clear toner plane data, when the image forming unit receives the second print data, the image forming unit applies the special color toner to the special color area of the second recording medium stored in the second sheet feed tray that is defined in the second clear toner plane data and applies the color toner to the color area defined in the color plane data, and when the image forming unit receives the third print data, the image forming unit applies the special color toner to the special color area of the first recording medium stored in the first sheet feed tray that is defined in the second clear toner plane data and applies the color toner to the color area defined in the color plane data.

3. The image forming apparatus according to claim 1, wherein the special color toner is clear toner, metallic toner, or white toner.

4. The image forming apparatus according to claim 1, further comprising a charge calculating unit configured to determine a charge count value used for calculating charge information in accordance with at least one of the first clear toner plane data, the color plane data, and the second clear toner plane data included in the output data.

5. An image forming method comprising:

acquiring output data that includes at least one of first image data and second image data, the first image data including first clear toner plane data that defines a special color area to which special color toner is applied for a first recording medium to which the special color toner has not been applied, and the second image data including color plane data and second clear toner plane data, the color plane data defining a color area to which color toner is applied for the first recording medium or a second recording medium to which the special color toner has been applied, the second clear toner plane data defining a special color area to which the special color toner is applied for the first recording medium or the second recording medium;

outputting, when the output data includes the first image data, first print data that includes the first clear toner plane data and first identification information representing an instruction to form an image on the first recording medium stored in a first sheet feed tray that stores the first recording medium to an image forming unit; and outputting, when the output data includes the first image data and the second image data, second print data that includes the second clear toner plane data, the color plane data, and second identification information representing an instruction to form an image on the second recording medium stored in a second sheet feed tray that stores the second recording medium to the image forming unit, and outputting, when the output data does not include the first image data but includes the second image data, third print data that includes the second clear toner plane data, the color plane data, and the first identification information to the image forming unit.

6. A computer program product comprising a non-transitory computer-readable medium containing a computer program that causes a computer to perform:

acquiring output data that includes at least one of first image data and second image data, the first image data including first clear toner plane data that defines a special color area to which special color toner is applied for a first recording medium to which the special color toner has not been applied, and the second image data including color plane data and second clear toner plane data, the color plane data defining a color area to which color toner is applied for the first recording medium or a second recording medium to which the special color toner has been applied, the second clear toner plane data defining a special color area to which the special color toner is applied for the first recording medium or the second recording medium;

outputting, when the output data includes the first image data, first print data that includes the first clear toner plane data and first identification information representing an instruction to form an image on the first recording medium stored in a first sheet feed tray that stores the first recording medium to an image forming unit; and outputting, when the output data includes the first image data and the second image data, second print data that includes the second clear toner plane data, the color plane data, and second identification information representing an instruction to form an image on the second recording medium stored in a second sheet feed tray that stores the second recording medium to the image forming unit, and outputting, when the output data does not include the first image data but includes the second image data, third print data that includes the second clear toner plane data, the color plane data, and the first identification information to the image forming unit.

* * * * *